US006916243B2

(12) United States Patent
Yoshida

(10) Patent No.: US 6,916,243 B2
(45) Date of Patent: Jul. 12, 2005

(54) GAMING MACHINE

(75) Inventor: Keiichi Yoshida, Tokyo (JP)

(73) Assignee: Konami Corporation, Tokyo (JP)

( * ) Notice: Subject to any disclaimer, the term of this patent is extended or adjusted under 35 U.S.C. 154(b) by 396 days.

(21) Appl. No.: 10/115,243

(22) Filed: Apr. 4, 2002

(65) Prior Publication Data

US 2002/0155881 A1 Oct. 24, 2002

(30) Foreign Application Priority Data

Apr. 6, 2001 (JP) ..... P.2001-108029
Jan. 30, 2002 (JP) ..... P.2002-022054

(51) Int. Cl.[7] ..... A63F 9/24
(52) U.S. Cl. ..... 463/20; 463/16; 463/25
(58) Field of Search ..... 463/7, 10–13, 463/16, 17, 19, 20–22, 25, 26–28

(56) References Cited

U.S. PATENT DOCUMENTS 6,142,873 A * 11/2000 Weiss et al. ..... 463/20
6,168,523 B1 * 1/2001 Piechowiak et al. ..... 463/26
6,203,430 B1 * 3/2001 Walker et al. ..... 463/20
6,328,649 B1 * 12/2001 Randall et al. ..... 463/20

FOREIGN PATENT DOCUMENTS

JP 7-31725 A 2/1995
JP 10-201911 A 8/1998
JP 11-19276 A 1/1999
JP 2000-334143 A 12/2000
JP 2000-342745 A 12/2000
JP 2001-29584 A 2/2001
JP 2001-87455 A 4/2001
JP 2001-145736 A 5/2001
JP 2001-269441 A 10/2001
JP 2002-52137 A 2/2002

* cited by examiner

*Primary Examiner*—Michael O'Neill
(74) *Attorney, Agent, or Firm*—Sughrue Mion, PLLC

(57) ABSTRACT

A first display displays a predetermined number of symbols among a plurality of symbols including at least one special symbol. A storage stores a first number of times that a special symbol combination is appeared on the first display, the special symbol combination includes a first symbol combination in which at least one special symbol is included and a second symbol combination which is a predetermined combination of the symbols. A determinant determines whether the first number of times stored in the storage is not less than a second, predetermined number. A signal generator generates an award signal for causing the gaming machine to provide an award to a player in accordance with the special symbol combination displayed on the first display, when the determinant determines the first number of times is not less than the second number of times.

18 Claims, 14 Drawing Sheets

GAMING MACHINE

BACKGROUND OF THE INVENTION

The present invention relates to a gaming machine, in which spinning symbols appear on a reel or a display of, e.g., a slot machine or poker gaming machine, and wherein a gaming value, such as in the form of gaming tokens, is paid as a payout depending on the results of the display.

There has been widely known a gaming machine by way of which gaming tokens or cash are bet, as in the case of a slot machine or a poker gaming machine, and which pays gaming tokens or cash to a player depending on the results of symbols appearing on a display device.

Such a gaming machine usually determines the result of a game as a "win" or "hit," a "defeat" or "failure," or a "draw" or "free spin." Only when a "win" or "hit" has arisen, a payout corresponding to displayed symbols or a winning combination; that is, a combination of symbols, is paid.

Some slot machines have a plurality of reels, each having plural kinds of symbols printed on a columnar outer peripheral face thereof; a display window for displaying the reels, and a start lever for starting a game. There are also video-type slot machines, wherein symbols to be displayed on an imaging device are switched in place of physical reels being spun. In these slot machines, a player can view, e.g., three symbols, in one display column via one window.

Three horizontal lines and two diagonal lines, which are across symbols appearing in respective display columns, are called winning lines. When a player inserts gaming tokens, one or more winning lines corresponding to the number of gaming tokens inserted become effective. When the player pushes down the start lever, all reels start spinning in unison. After lapse of a predetermined time period, the reels stop spinning. If all symbols which constitute a certain winning combination stop and are aligned along one of the effective winning lines, a corresponding winning mode is constituted, and the player achieves winning. As a result, the player can acquire a payout corresponding to the thus-constituted winning combination. If the player again inserts gaming tokens, he/she can start the next game.

There has recently become popular a slot machine which performs lottery operation with actuation of a start lever as a game start, and displays symbols on the basis of the results of lottery.

Some slot machines have stop buttons located below the respective display columns, wherein display results vary according to a timing at which the player presses the respective stop buttons, as well as in accordance with the lottery result.

In order to enhance the interest of the player, some slot machines provide, in addition to ordinary games, a "big bonus game" corresponding to a "big win."

A bonus game is classified into several types; namely, one type of bonus game affords the right to acquire a bonus payout when bonus symbols are aligned with a winning line and offers a bonus payout if the player can satisfy a predetermined requirement defined by subsequent sub-games; and another type of bonus game offers several free games which do not involve betting of additional gaming tokens.

A sub-game enables display of wild symbols. For example, a symbol of a safe can be displayed after appearance of a symbol of a banker. At the time of a bonus game, a die appears on the screen, and a payout is determined by the number of pips on the die. There is also a jackpot (big-payoff) game, such as a progressive game. Specifically, provided that the player is entitled the right to win a bonus, if the player has failed to acquire the bonus, a corresponding bonus payout is left for the next time. In a later game, a bonus payout plus the payout for the preceding bonus game are paid to a subsequent player who has acquired a bonus.

Particularly, the bonus-game provided by the slot machines equipped with stop buttons include "big bonus-game." According to this game, the probability of generation of a "regular bonus award" corresponding to a mid-sized win and a "small winning combination" corresponding to a small win are set high. Here, the "regular bonus award" means an award which enables the player to play a "jackpot game" involving a considerably high probability of generation of a win, which occurs when identical symbols; e.g., BAR-BAR-BAR, are aligned. Here, the "jackpot game" is a game in which either an award or failure is selected through internal lottery operation. The "jackpot game" is usually completed when 12 games are played or winning is achieved eight times, whichever comes first. After such a game involving a high probability of generation of a win has been played a predetermined number of times (e.g., a maximum of 30 times) or a regular bonus award has arisen a predetermined number of times (e.g., three times), the "big bonus game" is terminated, and ordinary play is resumed.

Through such a "big bonus game," the player can usually acquire 400 to 600 gaming tokens. If a game result has achieved a "big win," the player can acquire a greater number of gaming tokens than in an ordinary game. Thus, a gaming machine which effects a "big bonus game" can enhance the interest of the player whose goal is acquisition of the highest possible number of gaming tokens.

Of the slot machines equipped with stop buttons, some slot machines are designed to make it easier for the player to acquire more gaming tokens, by a "notification game" or the like which always notifies to the player information relevant to an internally-generated specific award. The player can acquire profit only when having won games.

In addition to the above-described gaming machines, video gaming machines further include a poker gaming machine and a blackjack gaming machine, which are of table game type.

These video games correspond to mere embodiment of conventional card games in the form of gaming machines. Payout is effected for existing winning combinations according to existing odds.

However, such a gaming machine provides no payout or prize unless the player has a win or hit. A luckless player will lose or fail to win games many times even when playing games continuously over a long time period, and hence the players interest in games is lost. Particularly in the case of a gaming machine equipped with reel stop buttons, a beginner cannot acquire a win even when a winning has been internally generated through internal lottery operation, and play ends in consumption of gaming tokens. Even when one specific symbol which rarely appears is displayed, no prize is offered. Even when on several occasions the display has shown a combination of symbols which would constitute a winning combination if only one more symbol were to appear, despite a winning having been internally produced through internal lottery operation, no prize is provided for the player.

Games to be played on a video gaming machine using a card provide only winning combinations and odds that comply with rules of existing games, thereby spoiling the player's enjoyment.

Even when such tantalizingly-close-to-winning games have arisen frequently, such a gaming machine provides no redress. Beginners in particular cannot enjoy the entertainment of games of the gaming machine.

Such a gaming machine has no function of displaying the number of times a win has been achieved by a winning combination since a game was started. In other words, there has not been available any means which causes the player to ascertain how many times the player has achieved winning in a game through a winning combination thus far. The number of gaming tokens to be paid and game conditions are determined according to whether or not a player has achieved a win during a certain game. For this reason, even a player who has had a lot of wins or played over a long time period plays a game under the same conditions as those under which a player who has had a smaller number of wins or has just started, and the flow of a game becomes monotonous.

SUMMARY OF THE INVENTION

It is therefore an object of the invention to provide a gaming machine which enhances the player's interest in a game, by way of accumulating the number of times a predetermined winning combination or predetermined symbols have obtained, thereby enhancing the amusement of playing a game continuously over a long time period, and maintaining great interest in playing a game.

In order to achieve the above object, according to the present invention, there is provided a gaming machine, comprising:

a first display, which displays a predetermined number of symbols among a plurality of symbols including at least one special symbol; and a controller, which includes:

a storage, which stores a first number of times that a special symbol combination is appeared on the first display, the special symbol combination includes a first symbol combination in which at least one special symbol is included and a second symbol combination which is a predetermined combination of the symbols;

a determinant, which determines whether the first number of times stored in the storage is not less than a second, predetermined number of times; and a signal generator, which generates an award signal for causing the gaming machine to provide an award to a player in accordance with the special symbol combination displayed on the first display, when the determinant determines the first number of times is not less than the second number of times.

In this gaming machine, the player's amusement is enhanced by accumulating the number of the special symbol combinations or by continuing a game. This in turn increases the amusement of receiving a reward as a result of the special symbol combination appearing on the first display.

Preferably, the controller includes a lottery processor, which determines the second number of times.

In this gaming machine, it is varied the difficulty level of requirements to be satisfied to obtain the award, thereby further enhancing the player's amusement by providing a tense atmosphere.

Preferably, the controller determines the symbol combination displayed on the first display.

In this gaming machine, the leading control or the like can be performed so that hitting of the special symbol combination is not highly dependent on the player's skill. Thereby, a total rate of gaming tokens paid during business hours of one day in an amusement arcade can be maintained substantially constant.

Preferably, the controller includes a counter, which counts a third number of times that a basic game is played, and compares with a fourth number of times. The signal generator is prohibited to generate the award signal when the third number of times is not less than the fourth number of times.

In this gaming machine, if the special symbol combination is not displayed a specified number of times (e.g., five times) during the course of a predetermined number of games (e.g., 30 games), no reward is afforded. Hence, a tense atmosphere is enhanced further.

Preferably, the second symbol combination is a special hand defined in a game. Alternatively, the second symbol combination is a specific symbol combination appeared at a location specified by the player.

In this gaming machine, the player can ascertain the number of times the special symbol combination has been appeared during the course of being playing a game. Hence, the amusement of continuing games is enhanced.

Preferably, the second symbol combination is a symbol combination other than a special hand defined in a game. Here, it is preferable that the second symbol combination is a symbol combination in which only one symbol is different from the special hand.

Alternatively, the second symbol combination is a symbol combination different from a specific symbol combination appeared at a location specified by the player. Here, it is preferable that the symbol combination is a symbol combination in which only one symbol is different from the specific symbol combination.

In this gaming machine, when a combination is other than the special hand; that is, when a tantalizingly-close-to-winning game has arisen frequently, the player is provided with redress, thereby providing the player with an incentive to play a game continuously. Further, the player can experience the feeling of fulfillment as if having gained a profit, which is a reward for efforts.

Preferably, the award is a specific game which is different from a basic game.

In this gaming machine, the player can enjoy another game, thereby enjoying a reward that differs from a payout which would be gained when having won the game directly.

Preferably, the award is at least one basic game which requires no gaming value wagered.

In this gaming machine, the player can play a free game or free spin a game without wagering a gaming value, so that the player can eventually and indirectly increase the amount of gaming tokens or cash in his/her pocket, by being entitled to the right to gain the special symbol combination.

Preferably, the award is gaming values.

In this gaming machine, the amusement of playing a game continuously over a long time period is enhanced.

Preferably, the award is a higher probability that the special symbol combination appears in a next game.

In this gaming machine, the player's amusement in playing a game continuously for a long time period can be enhanced.

Preferably, the award is a promise that the special symbol combination appears in a next game.

In this gaming machine, the player's amusement in playing a game continuously for a long time period can be further enhanced.

Preferably, the gaming machine further comprises a second display. The first number of times is displayed on either one of the first display or the second display. Here, the first display refers to a window or a display, such as a CRT or liquid-crystal display, for displaying specific symbols; e.g., reel units. Further, the second display device refers to a display device; e.g., a liquid-crystal display, a 7-segment display device, or an LED.

In this gaming machine, the number of times that the special symbol combination has been appeared can be visually ascertained, or the player can ascertain the amount of play required for the player to gain an award. Hence, the player can concentrate on the game.

According to the present invention, there is also provided a gaming machine, comprising:

a plurality of reels;

a plurality of symbols provided on each of reels;

a plurality of winning lines;

a display, which displays a first number of times that one of a plurality of special symbol combinations appears on a winning line specified by a player, in a basic game; and a controller, which activates a special game in accordance with the special symbol combination appeared on the winning line, when the first number of times is not less than a second, predetermined number of times.

In this gaming machine, the player can ascertain the number of times the special symbol combination has appeared thus far. Hence, the player's amusement is enhanced by accumulating the number of times the special symbol combination is established to play the special game (e.g., a free spin game or a bonus game)

Preferably, the special game is at least one additional play of the basic game.

In this gaming machine, the player can play the basic game once again, thereby enhancing the players amusement by playing a game for a long time period.

Preferably, the controller determines a time period in which the additional play is effected, in accordance with the special combination appeared on the winning line.

In this gaming machine, the period of a free spin game changes according to the nature of the special symbol combination, thereby enabling the player to enjoy a game full of variety.

Preferably, the controller provides a higher probability that the special symbol combination appears on the specified winning line in the special game.

In this gaming machine, the player's amusement in continuing a game is enhanced.

Preferably, the display is entirely reset when the first number of times is equal to the second number of times.

In this gaming machine, the amusement of increasing the first number of times can be newly provided.

Preferably, the display is partly reset when the first number of times is equal to the second number of times.

In this gaming machine, there is obviated a necessity of refreshing all the games once more from the beginning after the second number of times has been achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will be described hereinbelow with reference to the accompanying drawings. Here, as a first embodiment of the invention, there will be described a case where the present invention is applied to a skill-stop type slot machine equipped with stop buttons (hereinafter, simply referred as a slot machine).

Figure 1:
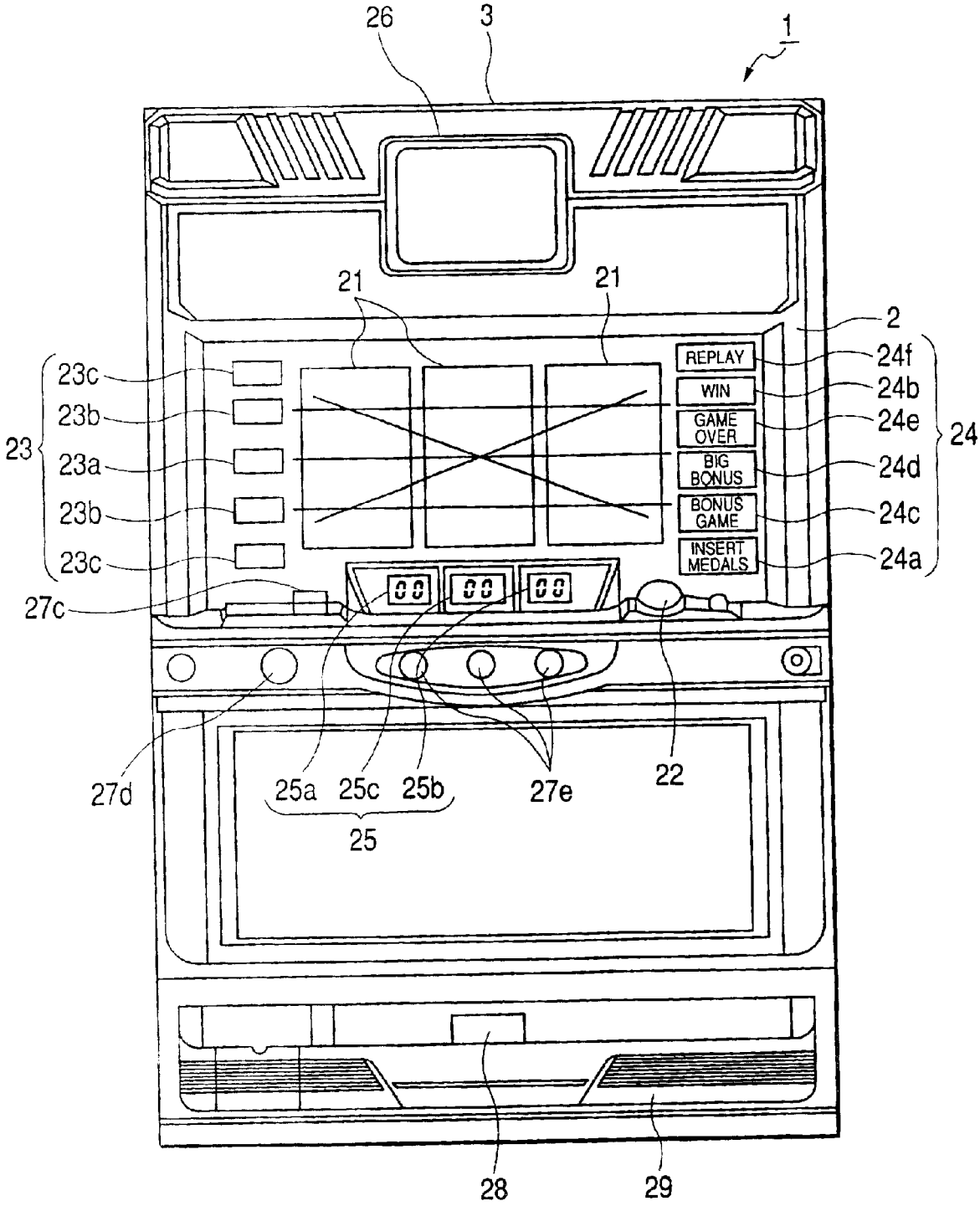
FIG. 1 is a front view showing the outer construction of a slot machine according to a first embodiment of the invention.

First, the configuration of such a slot machine will be described. As shown in FIG. 1, a slot machine 1 comprises a front panel 2 and a box-shaped cabinet section 3 for supporting the front panel 2 in a reclosable manner.

Provided on the front panel 2 are symbol display windows 21, each being able to display, three at a time, symbols printed on a corresponding reel; a slot 22 to be used for inserting gaming tokens serving as gaming mediums; lamp sections 23 provided to the left of the symbol display windows 21 (more specifically, a one-token-bet lamp 23*a*, a two-token-bet lamp 23*b*, and a three-token-bet lamp 23*c*); lamp sections 24 provided to the right of the symbol display windows 21 (more specifically, a gaming token insertion lamp 24*a*, a winning lamp 24*b*, a bonus game lamp 24*c*, a big bonus game lamp 24*d*, a game-over lamp 24*e*, and a free spin lamp 24*f*); a display section 25 situated below the symbol display windows 21 (a credit display section 25*a*, a payout display section 25*b*, and a number-of-bonus-game display section 25*c*); a liquid-crystal panel 26 located above the symbol display windows 21; control buttons to be operated by a player (i.e., a max-bet button 27*c*, a start button 27*d*, and stop buttons 27*e* provided for the respective reels); a payout port 28 for paying out gaming tokens; and a token receiver 29 for receiving the thus-paid gaming tokens.

Figure 3:
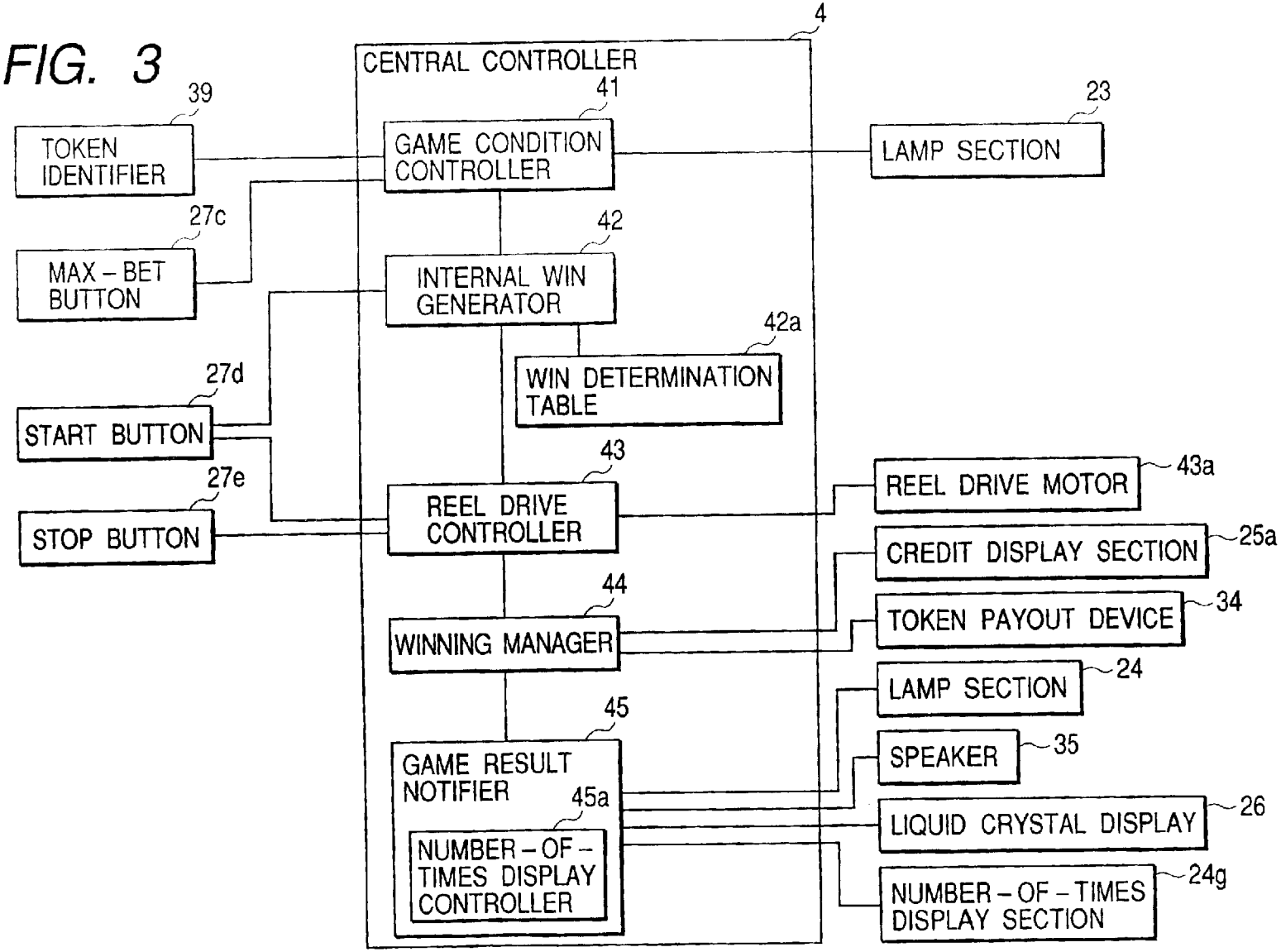
FIG. 3 is a block diagram showing the functional configuration of the slot machine.

Further, a token identifier 39 (see FIG. 3) is disposed behind the front panel 2 and connected to the token insertion slot 22 for identifying whether an inserted gaming token is genuine or counterfeit and for counting the number of inserted gaming tokens.

Figure 2:
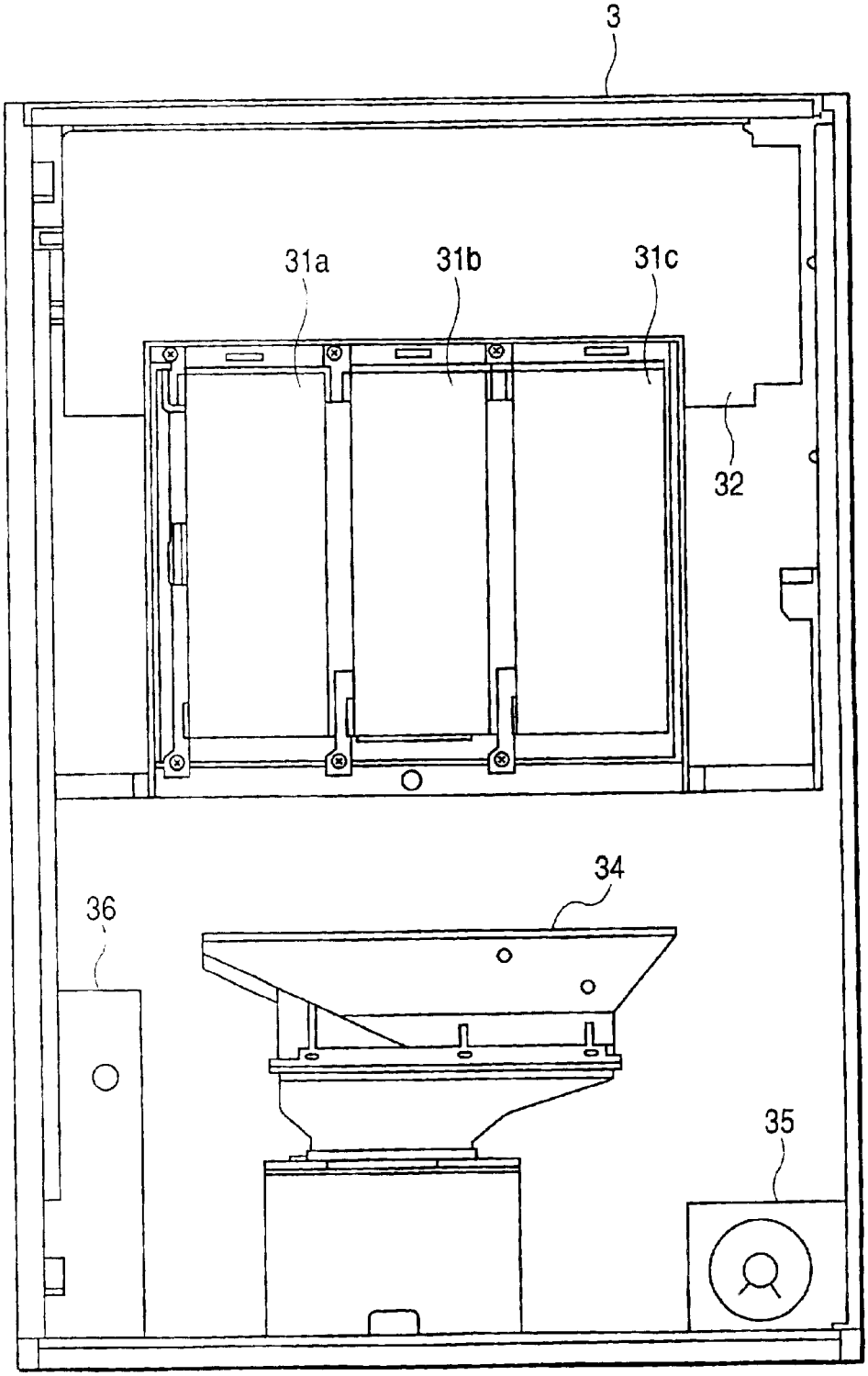
FIG. 2 is a schematic diagram showing the internal construction of the slot machine.

FIG. 2 is a schematic view showing the internal configuration of the slot machine 1. Incorporated in a cabinet 3 are three reels 31*a* through 31*c*, each having a plurality of symbols printed on an outer circumferential face thereof; a circuit board 32 required for effecting various types of control operations, including control of spinning action of the reels 31*a* through 31*c*; a token payout device 34 capable of reserving and paying out a number of gaming tokens (e.g., 200 gaming tokens); a speaker 35 for outputting various sound effects; and a power box 36 for supplying power to individual sections.

There will now be described the procedures involved in a game which employs the slot machine 1 having the foregoing construction, as well as the outline of operation to be performed for effecting the procedures by the slot machine 1. When a player plays a game on the slot machine 1, the player first inserts a gaming token into the token insertion slot 22. At this time, the gaming token insertion lamp 24*a* on the front panel 2 is illuminated for prompting the player to insert a gaming token.

When the gaming token is inserted, the token identifier 39 connected to the token insertion slot 22 determines whether or not the inserted gaming token is genuine. A gaming token that has been determined to be genuine on the basis of a predetermined requirement by the token identifier 39 is counted as a genuine gaming token and delivered to a token payout device 34. In contrast, a gaming token that has been determined to be counterfeit is not counted and is returned by way of the token payout port 28.

When a genuine gaming token is counted, the lamp section 23 on the front panel 2 is illuminated in accordance with the number of a count value. For instance, if a count value is one, the one-token-bet lamp 23*a* is illuminated, thereby reporting, to the player, the number of wagered gaming tokens being set to one. If the count value is two, the one-token-bet lamp 23*a* and the two-token-bet lamp 23*b* are illuminated, thereby reporting, to the player, the number of wagered gaming tokens being set to two. Further, if the count value is three, the one-token-bet lamp 23*a*, the two-token-bet lamp 23*b*, and the three-token-bet lamp 23*c* are all illuminated, thereby reporting, to the player, the number of wagered gaming tokens being set to three. Thus, the lamp section 23 also serves to display effective line(s) across the three reels 31*a* through 31*c*.

If the count number is four or more, the number of gaming tokens exceeding three is digitally displayed in a credit display section 25*a* on the front panel 2. A display (i.e., a credit display) appearing on the credit display section 25*a* is incremented and updated by one every time a gaming token is inserted. If a gaming token is inserted when the gaming token insertion lamp 24*a* remains extinguished for reason of the number of credits having reached a preset restriction imposed on the number of credits (e.g., 50) or a like reason, the thus-inserted gaming token is not counted and is returned by way of the token payout port 28.

Provided that a display appearing on the credit display section 25*a* has already reached three or more, if the player presses a max-bet button 27*c*, the credit display is decremented by three and updated, all the lamps 23*a* through 23*c* in the lamp section 23 are illuminated, and the number of wagered gaming tokens is set to three. Thus, setting of the number of wagered gaming tokens can be performed not only by inserting a gaming token, by also by pressing the max-bet button 27*c*. However, when the credit display appearing on the credit display section 25*a* is one or two, the number of wagered gaming tokens corresponding to the number of credits (i.e., one or two gaming tokens) is set by pressing the max-bet button 27*c*.

If the number of wagered gaming tokens is set to three by inserting gaming tokens into the token insertion slot 22 or pressing the max-bet button 27*c*, the player becomes able to actuate the start button 27*d*. At this time, the front panel 2 may report this to the player by illumination of lamps. After the number of wagered gaming tokens has been set to three, the player actuates the start button 27*d* to request commencement of a game. The three reels 31*a* through 31*c* start spinning by driving of reel driving motors (e.g., stepping motors) to be described later, and display of various symbols is started. Subsequently, when the player presses the stop buttons 27*e*, the reels 31*a* through 31*c* assigned to the stop buttons 27*e* stop spinning individually. If the player does not press the stop button 27*e*, the reels 31*a* through 31*c* automatically stop spinning after lapse of a predetermined time period.

When all the reels 31*a* through 31*c* have stopped, one game ends. Combination(s) of the symbols aligned with the effective line(s) (i.e., winning determination line(s)) across the symbol display windows 21 are individually compared with predetermined "winning combinations," thereby determining the result of a game; that is, occurrence of winning. At this time, a total of five lines across the symbol display windows 21; namely, three horizontal three lines and two diagonal lines, can serve as winning determination lines, Comparison and determination of the symbols are performed by a control function to be embodied on a circuit board 32 to be described later.

Game results are roughly classified into "Win," "Failure," and "Free spin." "Win" is classified into a "small win (a small win combination)," a "mid-sized win (a regular bonus)," and a "big win (a big bonus)."

When symbols for a small win other than those to be described later are aligned with a winning determination line, a game result is determined to be a "small win" from among "wins." As a result, a predetermined number of gaming tokens (e.g., 2 to 15) are paid out in accordance with the kind of aligned symbols, and the credit display is incremented, or gaming tokens are paid out by way of the token payout port 28. In this case, the player is informed that the game result is a small win, by illumination of the win lamp 24*b* of the front panel 2. Further, the number of gaming tokens to be paid is notified to the player by a digital display appearing on the payout display section 25*b*.

When symbols for a regular bonus (e.g., "BAR") are aligned with the winning determination line, the game result is determined to be a "regular bonus" from among the "wins." In addition to a predetermined number of gaming tokens to be paid out (e.g., 15), a special game called "regular bonus game" can be performed a predetermined number of times. In this case, the player is informed that the game result is a regular bonus award, by illumination of the number-of-bonus-game display section 25*c* of the front panel 2.

At the time of a regular bonus game, a special game advantageous to the player is continued only a predetermined number of times (e.g., a maximum of 12 times). Although the number of gaming tokens which are to be bet for each regular bonus game is one, a predetermined number of gaming tokens (e.g., 15) can be paid out as a result of predetermined symbols (e.g., "JAC") being aligned with a winning determination line (this win will hereinafter be called a "JACKPOT award"). When a predetermined number of special games have been completed or a JACKPOT win has arisen a predetermined number of times (e.g., 8 times), the regular bonus game ends, and a normal game is resumed.

When symbols for a big bonus (e.g., "7" or "A") are aligned with a winning determination line, the game result is determined to be a "big bonus" from among the "Wins." In addition to a predetermined number of gaming tokens to be paid (e.g., 15), a special game called a "big bonus game" can be played until predetermined requirements for a special game are satisfied. In this case, the player is informed that the game result is a big bonus award, by illumination of the big bonus game lamp section 24*d* of the front panel 2.

At the time of a big bonus game, a special game which is more advantageous to the player than that offered at the time of a regular bonus game is continued the predetermined maximum number of times (e.g., 30 times in most instances). By a big bonus game, gaming tokens are paid as a result of occurrence of a small win award or a regular bonus award, as in the case of an ordinary game. The probability of generation of a small win award or a regular bonus award becomes higher than in a normal game. When a predetermined number of special games have been completed or the regular bonus award has arisen a predetermined number of times (e.g., three times in most instances), the big bonus game ends, and a normal game is resumed.

The number of times a regular bonus game or big bonus game has been played is notified to the player by way of an indication appearing on the number-of-bonus-game display section 25*c* of the front panel 2. As in the case of a small win award, the number of gaming tokens to be paid during a regular bonus game or big bonus game is digitally displayed on the payout display section 25*b*.

When identical symbols fail to be aligned with any winning determination line, the game result is determined to be a "failure," and no privilege is afforded to the player.

If the symbols aligned with a winning determination line correspond to free spin symbols, the game result is a "free spin" corresponding to a so-called draw, and no gaming tokens are paid out. However, the player can again play a game under the same conditions as those for the game that has ended in the "free spin," without inserting or betting a new gaming token. In this case, the player is informed that the game result is a "free spin," by illumination of the free spin lamp section 24*f* of the front panel 2.

In this way, when one game has ended, a game result has been determined, and the game result has been notified in the manner as mentioned previously, the player successively plays the next game corresponding to the notified game result.

The game result may be notified not only by illumination of the lamp section 24 as mentioned above, but also by combination of blinking of the lamp section 24 and output of sound effects from the speaker 35.

The functional configuration of the slot machine 1 required for controlling various types of operations will now be required, including the previously-described determination of a game result. On the circuit board 32 of the slot machine 1, a central controller (microcomputer) 4 is constituted by combination of a CPU (central processing unit), ROM (read-only-memory), RAM (random-access-memory), and various interfaces. The central controller 4 implements functions corresponding to a game condition controller 41, an internal win generator 42, a reel drive controller 43, a winning manager 44, and a game result notifier 45.

The game condition controller 41 is for controlling conditions for starting a game. Upon receipt of a report concerning a count value of gaming tokens output from the token identifier 39, a report concerning depression of the max-bet button 27*c*, or a report concerning a win resulting from a "free spin" output from the winning manager 44, the game condition controller 41 determines that the game can be started. In response to the determination, the lamp section 23 provided on the front panel 2 is illuminated, and the speaker 35 outputs sound effects. As a result, the player is informed of conditions for a game which the player is about to start (i.e., the number of tokens bet and effective lines).

Upon detection of the player actuating the start button 27*d* after the game condition controller 41 has notified game conditions, the internal win generator 42 performs so-called internal lottery operation in connection with a game which is about to be started through activation of the start button 27*d*. Here, internal lottery operation means determination of a game result; that is, a winning combination for a game, which comes about through internal lottery operation performed in the slot machine 1 prior to completion of the game.

The internal win generator 42 performs such an internal lottery operation by utilization of random numbers. Upon detection of actuation of the start button 27*d* (i.e., start of a game), the internal win generator 42 generates random numbers through use of a random number generator (the random numbers will hereinafter be referred to as "random numbers for determining a win" or as simply "random numbers"). On the basis of a win determination table 42*a* which has been prepared beforehand and describes a correspondence between values of random numbers and a numerical range of a winning combination, the internal win generator 42 determines a numerical range into which values of generated random numbers fall. In this way, the internal win generator 42 specifies a winning combination which is to be derived from the generated random numbers.

At this time, in connection with the win determination table 42*a* which serves as a basis for determining a winning combination, numerical ranges are specified for respective winning combinations. The sizes of the numerical ranges differ from one winning combination to another winning combination. Thus, a difference arises between the winning combinations in terms of probability of generation, For example, a numerical range concerning a "big bonus" is small, and hence the probability of generation of a big bonus is low. In contrast, a numerical range concerning a "failure" is wide, and the probability of generation of a failure is high.

Internal lottery is determined by a numerical range on the win determination table 42*a* to which values of random numbers pertain. A winning combination which is to be hit is determined by a probability corresponding to data settings provided in the win determination table 42*a*. Hence, hitting of a winning combination is not highly dependent on the player's skill. For example, a total rate of gaming tokens paid during business hours of one day in an amusement arcade is maintained substantially constant.

The internal win generator 42 has two win determination tables 42*a*, which differ from each other in probability of generation. As will be described in detail later, an appropriate one is selected from the win determination tables 42*a*, as required. The win determination tables 42*a* differ from each other in terms of the probability of generation of a "free spin." In other words, one of the win determination tables 42*a* (hereinafter called a "normal table") is arranged such that ranges of numerical values are defined for a "win," a "failure," and a "free spin," respectively.

In contrast, the other win determination table 42*a* (hereinafter called a "free spin table") is arranged such that the range of numerical values assigned to the "failure" is replaced with that assigned to a "free spin." As a result, the free spin table has a higher probability of generation of a "free spin" than does the normal table. In connection with the replacement of the range of numerical values performed in the free spin table, the entire range of numerical values assigned to a "failure" may be replaced with that assigned to a "free spin," or part of the range of numerical ranges assigned to a "failure" may be replaced with that assigned to a "free spin."

The reel drive controller 43 controls spinning operations of the respective reels 31*a* through 31*c*. Upon detection of the player having actuated the start button 27, the reel drive controller 43 sends a drive instruction to the reel driving motors. Upon detection of the player having pressed the stop button 27*e* or of a predetermined time period having elapsed since the start button 27*d* was actuated, the reel drive controller 43 sends a stop instruction to the reel driving motors, thereby stopping the reels 31*a* through 31*c*.

At the time of stoppage of the reels 31*a* through 31*c*, the reel drive controller 43 performs leading control operations of the respective reels 31*a* through 31*c*. Here, the leading control operation refers to control of stop timings of the respective reels 31*a* through 31*c* so as to comply with the result of internal lottery operation performed by the internal win generator 42.

For instance, in a case where the reels 31*a* through 31*c* are stopped in response to depression of the stop buttons 27*e*, the reel drive controller 43 deactivates the reels 31*a* through 31*c* within a predetermined time period (e.g., a period of 190 msec.) since the stop buttons 27*e* were pressed. However, a time period before stoppage of the reels 31*a* through 31*c* is not necessarily fixed to the same value across the board. Symbols to be stationary displayed are controlled so as to comply with the result of internal lottery operation performed by the internal win generator 42 within the range of a predetermined time period. As a result the positions where the reels 31*a* through 31*c* are to be stopped can be adjusted by only a maximum of, e.g., four symbols. If the result of internal lottery operation performed by the internal win generator 42 is a "failure," corresponding symbols are not aligned with a winning determination line even when the player has pressed the stop buttons 27*e* at a timing at which a "win" is generated. In contrast, if the result of internal lottery operation performed by the internal win generator 42 is a "win," the respective reels 31*a* through 31*c* are stopped such that corresponding symbols are aligned with a winning determination line.

There may arise a case where the player fails to align corresponding symbols on the respective reels 31 through 31*c* with a winning determination line despite a winning flag having been set as a result of internal lottery operation performed by the internal win generator 42. In such a case, the reel drive controller 43 can inform the player of the result of internal lottery operation performed by the internal win generator 42, by changing the symbols stationary displayed on the respective reels 31*a* through 31*c* to those differing from ordinary symbols. However, if the result of internal lottery operation is valid during only one game, as in the case of a small win, display of special symbols is meaningless. For this reason, in such a case no special symbol is displayed.

The leading control operation to be performed by such a reel drive controller 43 can be implemented, because the reel driving motors for driving the reels 31*a* through 31*c* are constituted of stepping motors, The reel drive controller 43 can ascertain the symbols displayed on the reels 31*a* through 31*c* along a winning determination line at all times through pulse control operation of the reel driving motors. Hence, a leading control operation such as that described above can be performed.

The winning manager 44 compares predetermined "winning combinations" with the symbols on the reels 31*a* through 31*c* appearing on a winning determination line as a result of the reels having been stopped by the reel drive controller 43, thereby determining the result of a game; that is, generation of a win in the game. In more detail, limitations are imposed on the range of adjustment of symbols to be stationary displayed as a result of the leading control operation being performed by the reel drive controller 43 The result of a game is determined to be a "win" or "free spin," so long as the result of internal lottery operation performed by the internal win generator 42 is a "win" or "free spin" and the symbols, which are displayed on the reels 31*a* through 31*b* and aligned with a winning determination line as a result of the reels having been stopped by the reel drive controller 43, correspond to a "win" or "free spin." At all other times, all game results are determined to be "failures." The winning manager 44 sends an instruction to the credit display section 25*a* or the token payout device 34 on the front panel 2 such that gaming tokens are paid to the player in accordance with the result of determination.

If the winning manager 44 has determined the game result to be a "mid-sized win (i.e., a regular bonus)" or a "big win (i.e., a big bonus)," the internally-generated win is continued from then on, and a determination is made such that the player is allowed to play a "regular bonus game" or a "big bonus game" for only a predetermined time period. In association with the determination, requirements for terminating the predetermined time period are also set.

The game result notifier 45 illuminates (or blinks) the lamp section 24 of the front panel 2 or outputs sound effects by way of the speaker 35. The game result notifier 45 informs the player of the game result determined by the winning manager 44.

The game result notifier 45 includes a number-of-times display controller 45*a*. When symbols corresponding to a predetermined winning combination are aligned with a winning determination line, the number-of-times display controller 45*a* performs a control operation such that the liquid-crystal display 25 displays the number of times the symbols have been aligned. The number of times a predetermined winning combination has been generated is displayed on, e.g., a number-of-times display section 24*g* or the liquid crystal panel 26 in the form of an image.

Figure 4:
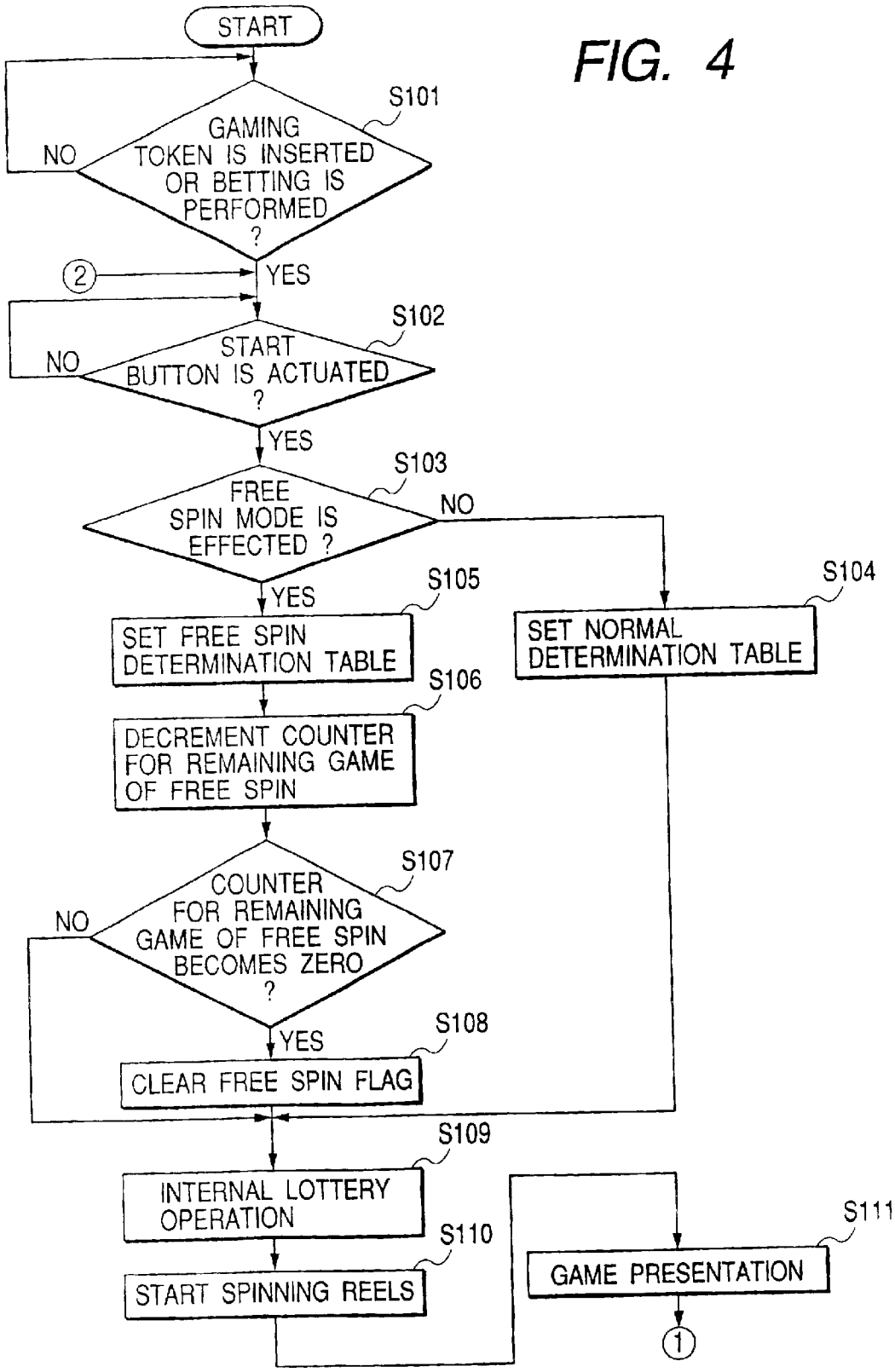
FIG. 4 is a first flowchart showing the outline of a control operation to be performed by a central controller provided in the slot machine.
Figure 5:
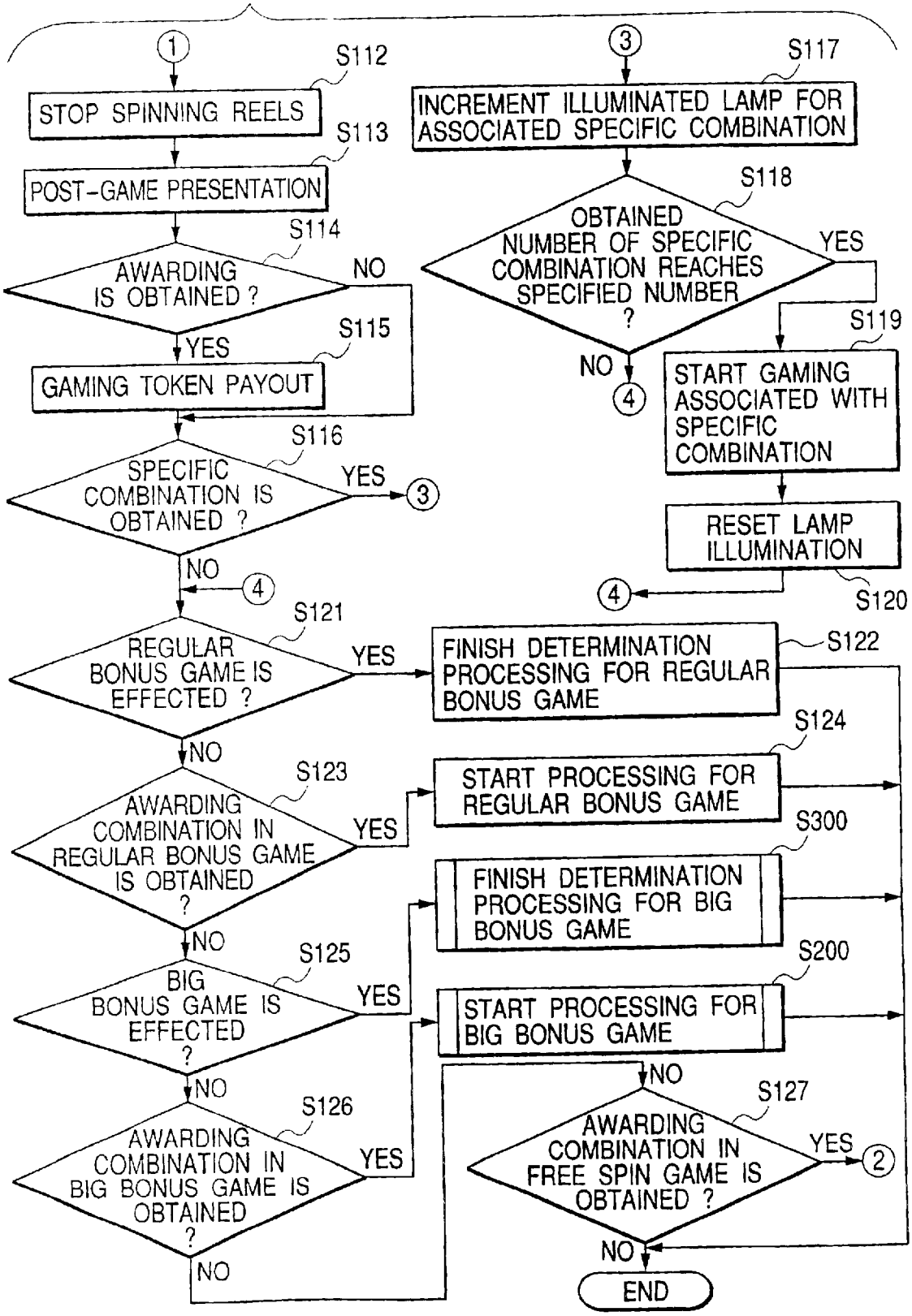
FIG. 5 is a second flowchart showing the outline of the control operation to be performed by the central controller provided in the slot machine.

There will now be described an example of control operation to be performed by the central controller 4 when a game is played on the slot machine 1, the controller 4 embodying the functional configuration set forth. FIGS. 4 and 5 are flowcharts showing the outline of a control processing operation to be performed by the central controller 4.

As shown in FIG. 4, upon detection of the start button 27*d* being actuated by the player (step S102; a "step" is hereinafter abbreviated as "S") after the player has inserted a gaming token or bet a gaming token (i.e., pressed the max-bet button 27*c*) (S101), the central controller 4 starts control operation for a game.

When the central controller 4 starts a control operation for a game, the internal win generator 42 determines whether or not the game is being played during a period of free spin game (S103). Here, the free spin game refers to a state (period) during which the probability of generation of a "free spin" has become high. Desirably, the internal win generator 42 renders this determination on the basis of whether or not a free spin-time flag, which is one of winning flags, is set.

If a determination is made that the game is not being played during the period of free spin game, the internal win generator 42 performs setting operation such that the win determination table 42*a* to be used as a basis for effecting internal lottery operation is set to a normal table (S104).

In contrast, if a determination has been made that the game is being played during the period of free spin game, the internal win generator 42 performs setting operation such that the win determination table 42*a* to be used as a basis for effecting internal lottery operation is set to a free spin table (S105). After the count of games remaining to be played during a free spin game has been decremented by "one" (S106), a determination is made as to whether or not the count has reached "zero" (S107). If the count has reached "zero," the free spin game flag is cleared (S108).

In this way, after the win determination table 42*a* has been set; namely, after the win determination table 42*a* has been set to either the normal table or the free spin table, the internal win generator 42 performs an internal lottery operation (S109). The reel drive controller 43 starts spinning the reels 31*a* through 31*c* (S110). Upon receipt of the result of internal lottery operation performed by the internal win generator 42, the game result notifier 45 may change a display mode (i.e., a presentation effect) of an image on the liquid-crystal panel 26, thereby performing a game presentation for the player (S111).

Subsequently, when the player has pressed the stop buttons 27*e* or a predetermined time period has elapsed, as shown in FIG. 5, the reel drive controller 43 stops spinning of the reels 31*a* through 31*c* while performing leading control of the reels 31*a* through 31*c* in accordance with the result of internal lottery operation performed by the internal win generator 42 (S112). At this time, if the player has failed to attain a win despite, e.g., a bonus win having been internally generated, the reel drive controller 43 may change a display mode of the symbols stationary displayed on the reels 31*a* through 31*c*, as required, thereby performing a post-game presentation (e.g., display of special symbols as described before) for the player (S113).

After the reel drive controller 43 has stopped the reels 31*a* through 31*c*, the winning manager 44 determines whether or not the player has won the game (S114). If the result of determination is a "win," an instruction is sent to the credit display section 25*a* or the token payout device 34, which are provided on the front panel 2, such that gaming tokens are paid to the player (S115).

Next, in order to display the number of wins when predetermined symbols are aligned, the win controller 44 determines whether or not the symbols, which are stationarily displayed on the reels 31*a* through 31*c* and aligned with the win determination line, are compared with the symbols corresponding to a display (e.g., indication of a lamp) determined beforehand (S116). When a winning combination of corresponding symbols is produced, the number of illuminated number-of-times display sections 24*g*, which represent the number of times a winning combination of corresponding symbols has been obtained, and are to be illuminated, is incremented by one (S117).

A determination is made as to whether or not the number of times the player has won has reached a predetermined number (S118). When the predetermined number has been reached, the game condition controller 41 performs a control operation so as to start a game corresponding to the symbols (S119) and resets the number-of-times display sections 24*g* representing the number of times the player has won. By the resetting operation, all of the lamps may be extinguished. Alternatively, some of the lamps may be extinguished, thereby leaving the others illuminated. When some of the lamps still remain illuminated, the number of remaining lamps is sequentially increased by occurrence of a win.

The win controller 44 determines whether or not the game that has ended as a result of stoppage of the reels 31*a* through 31*c* was in the course of a "regular bonus game" (S121). If so, a determination is made as to whether or not requirements for ending the "regular bonus game" (e.g., completion of a specified number of games) have been satisfied (S122). If in step S121 the game is determined to not have been in the course of the "regular bonus game," the win controller 44 determines whether or not the kind of the "win" corresponds to the "regular bonus game" (S123). If so, processing for starting the "regular bonus game" is performed (S124). Further, even when the kind of the "win" corresponds to an "regular bonus game" which arises during the course of a "big bonus game," the win controller 44 performs processing for starting the "regular bonus game" in the same manner.

In contrast, if the kind of the "win" does not correspond to the "regular bonus game," the win controller 44 determines whether or not the game that has ended as a result of stoppage of the reels 31*a* through 31*c* was in the course of the "big bonus game" (S125). If so, a determination is made as to whether or not requirements for ending the "big bonus game" (e.g., completion of a specified number of games) have been satisfied (S300). If in step S125 the game is determined not to be in the course of the "big bonus game," the win controller 44 determines whether or not the kind of the "win" corresponds to the "big bonus game" (S126). If so, processing for starting the "big bonus game" is performed (S200).

If the result of determination made as to whether or not the player has won the game represents not a "win" but a "free spin" corresponding to a draw (S127), the win controller 44 notifies this to the game condition controller 41. Upon receipt of the report, the game condition controller 41 notifies requirements for inserting a gaming token at the time of establishment of a free spin game; that is, requirements for inserting a gaming token in a "free spin game" which is about to be started next. More specifically, simulated token insertion sound corresponding to only the number of gaming tokens to be inserted at the time of establishment of a free spin game is output from the speaker 35. Moreover, the lamp section 23 on the front panel 2 is illuminated only the number of times equal to the number of gaming tokens to be inserted. Thus, the game condition controller 41 enables the player to play a free spin game without inserting or wagering new gaming tokens.

Figure 6:
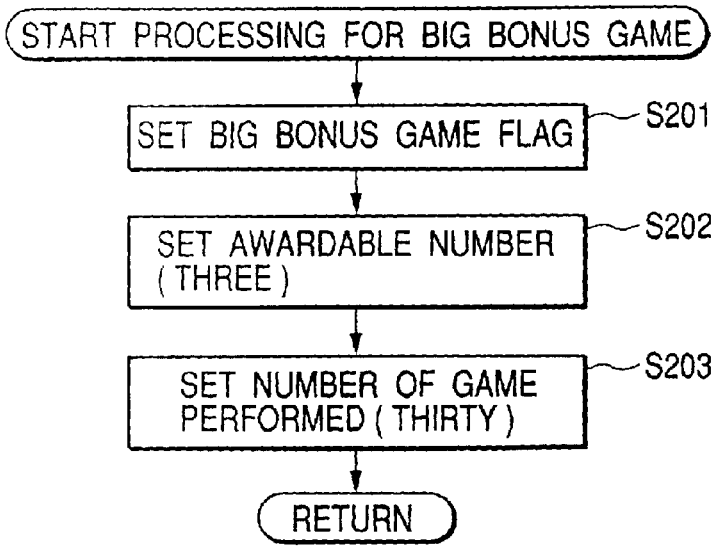
FIG. 6 is a flowchart showing the outline of start processing for a big bonus game to be performed by the central controller provided in the slot machine.

Start processing for a big bonus game to be performed in the course of the above-described control processing (i.e., processing pertaining to S200 shown in FIG. 5) will be described in more detail with reference to FIG. 6.

The start processing is performed when the kind of the "win" corresponds to a "big bonus game"; that is, when symbols for big bonus (e.g., "7" or "A") are aligned with the winning determination line. During the start processing, the win controller 44 first sets a big bonus game flag (S201). By setting such a winning flag, the win controller 44 informs the internal win generator 42 that the next game to be performed is a "big bonus game." Further, the win controller 44 sets the awardable number of the regular bonus game (e.g., three awards) and the maximum number of games (e,g., 30 games), which are requirements for completing the current "big bonus game" round, in a counter provided within a memory area to be used by the win controller 44 (S202, S203).

Figure 7:
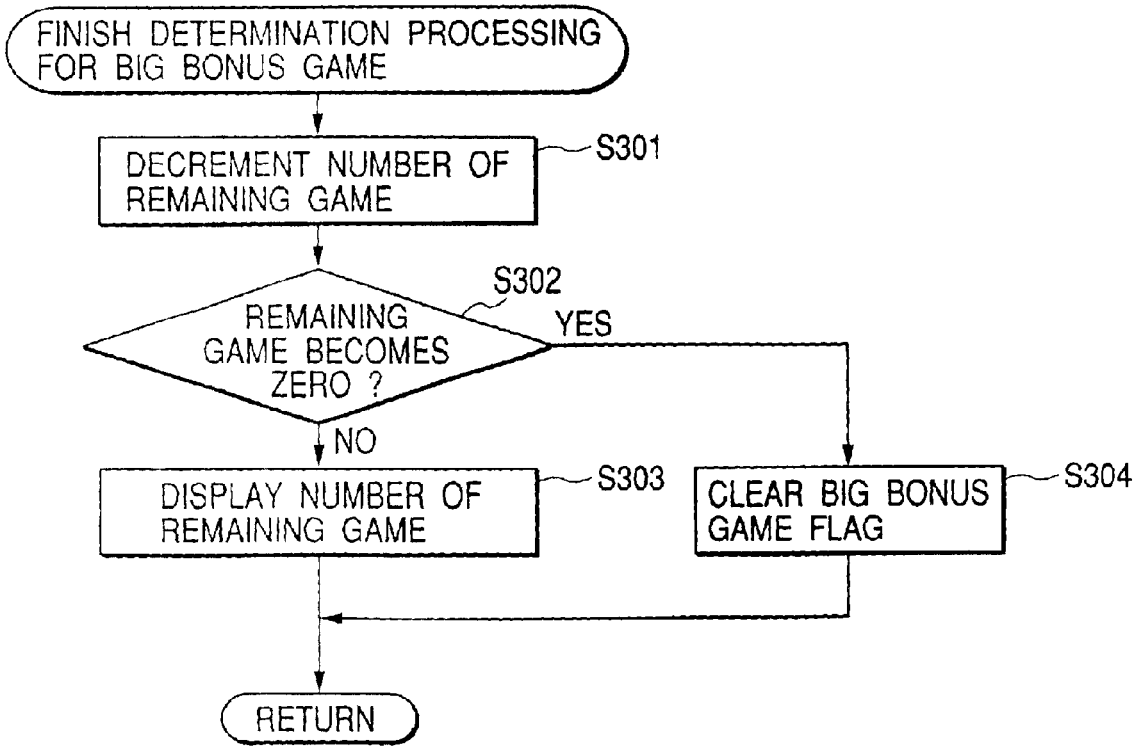
in FIG. 7 is a flowchart showing the outline of finish determination processing for the big bonus game to be performed by the central controller provided in the slot machine.

Subsequently, finish determination processing for the big bonus game to be performed in association with the above-scribed start processing (i.e., processing pertaining to S300 shown in FIG. 5) will now be described in more detail with reference to FIG. 7.

During the finish determination processing, the win controller 44 subtracts one from the number of games played during the period of a big bonus game or the number of times a regular bonus game having performed (these will be hereinafter generically called the "number of remaining games"), which is set on the counter (S301). A determination is made as to whether or not the number of remaining games is "zero" (S302). If not, the number of remaining games of the big bonus game is displayed on the number-of-bonus-game display section 25*c* (S303). The next game is also played under the same setting conditions of the big bonus game.

In contrast, if the number of remaining games in the "big bonus game" is zero (S302), the win controller 44 clears the big bonus game flag representing that the player is in the course of playing the "big bonus game" (S304), thereby terminating the "big bonus game."

Figure 8:
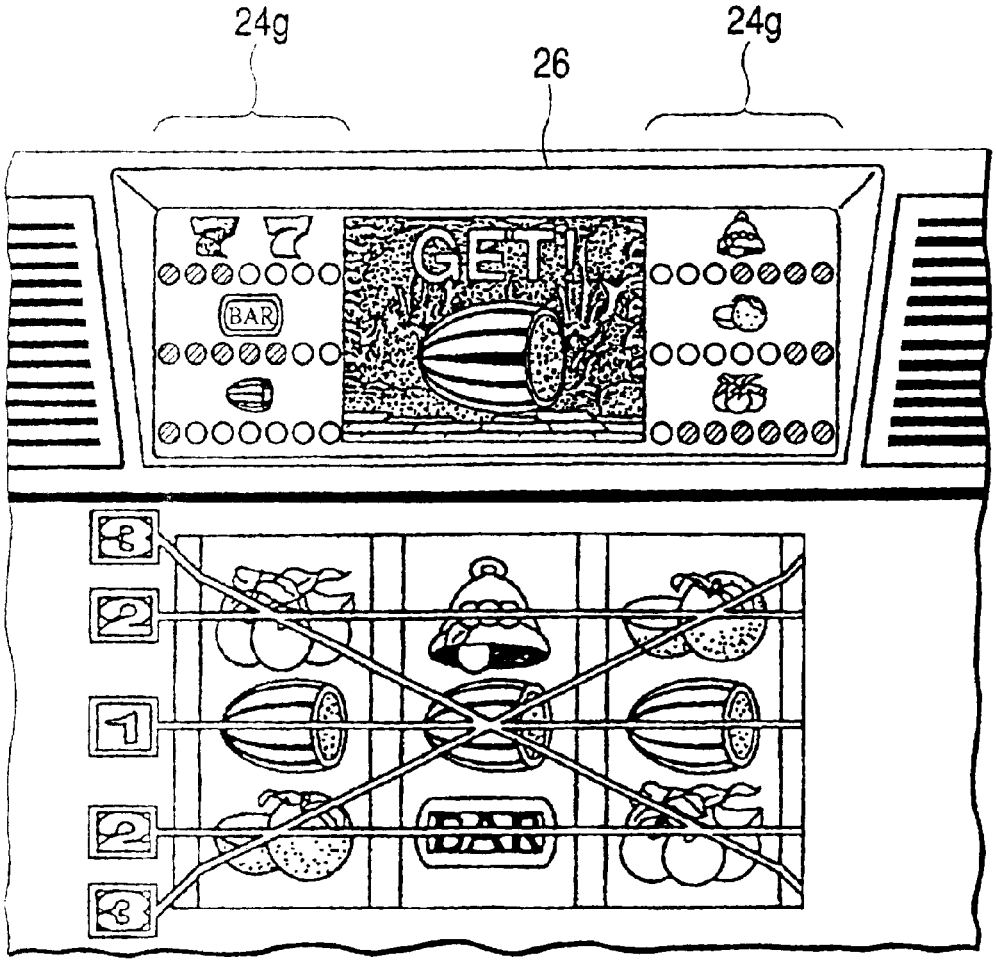
FIG. 8 is an illustration showing a display of the number of times winning combinations have obtained.

There will now be described a specific example of display of the number of times a win having obtained. FIG. 8 is a view showing the liquid-crystal panel 26 and the periphery of the reel section on the slot machine 1. The number-of-times display sections 24*g* are situated on both sides of the liquid-crystal panel 26. The number-of-times display sections 24*g* are constituted of, e.g., LEDs. For instance, seven LEDs are provided linearly for each of the symbols.

The game condition controller 41 sends a display signal to the number-of-times display sections 24*g*. Upon display of a combination of symbols, including specific symbols, or a combination of specific symbols, the game condition controller 41 sends to the number-of-times display sections 24*g* a signal for illuminating a corresponding lamp.

The game condition controller 41 comprises a storage, a determinant, and a signal generator. The storage stores the number of times a combination of symbols, including specific symbols or a combination of specific symbols, has been displayed on the number-of-times display sections 24*g*. Further, the determinant determines whether or not the number of times stored in the storage has become equal to or greater than a specified number of times. If the determinant determines that the combination of symbols has been displayed the specified number of times or more, the signal generator issues a signal for affording a reward.

Further, the game condition controller 41 has a lottery processor for determining the specified number of times, or specific symbols or a combination of symbols, which are to be counted.

In each of the number-of-times display sections 24*g*, LEDs equal in number to the number of times a winning combination has appeared are illuminated. For instance, in relation to symbol "7," four LEDs are illuminated, thereby representing that a winning combination has appeared four times since a game was started The number of illuminated LEDs corresponds to that stored in the storage of the game condition controller 41. When not all the LEDs are extinguished at the time of resetting operation but some of the LEDs remain illuminated, the number of the illuminated LEDs includes the number of times a winning combination has appeared.

Similarly, in the state shown in FIG. 8, two LEDs assigned to symbol "BAR" are illuminated; six LEDs assigned to symbol "WATERMELON" are illuminated; three LEDs assigned to symbol "BELL" are illuminated; five LEDs assigned to symbol "ORANGE" are illuminated; and one LED assigned to symbol "CHERRY" is illuminated.

Provided that symbols "WATERMELON" are aligned with a winning line (for example, a winning line designated by 1) in the next game, an image of "WATERMELON" and an indication of, e.g., "GET," are displayed on the liquid-crystal panel 26. Alternatively, a sound or sound effects may be output while an image is displayed.

Figure 9A:
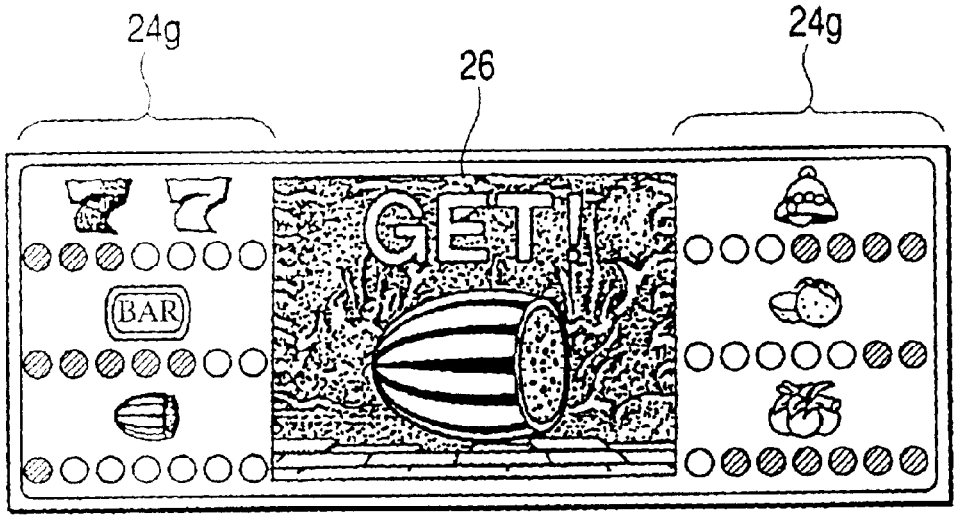
FIGS. 9A and 9B are illustrations showing the display when a specific winning combination has obtained.
Figure 9B:
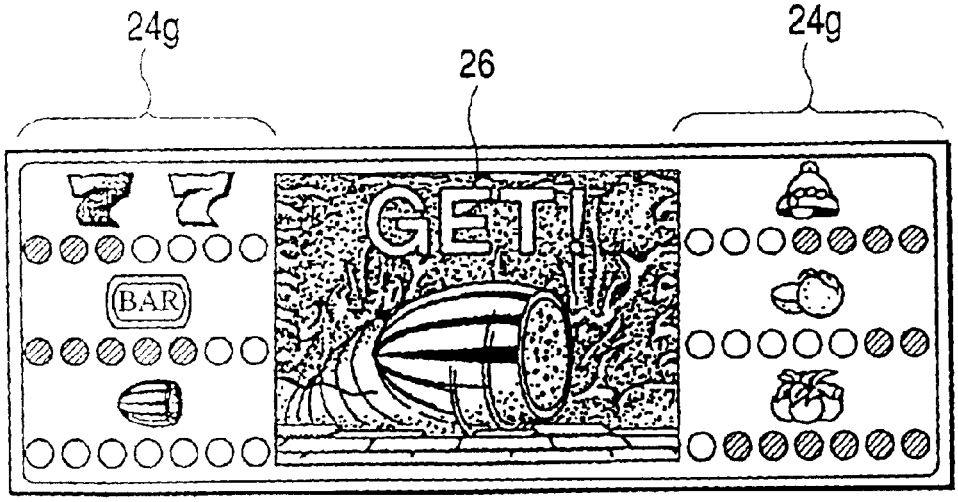

As shown in FIGS. 9A and 9B, the image of "WATERMELON" converges toward the number-of-times display sections 24*g* (i.e., the lower left corner of the liquid-crystal panel shown in FIG. 9B) along with an afterimage thereof, and eventually disappears. Then, the number of illuminating LEDs is incremented by one. The same also applies to the other symbols. When symbols are aligned with a winning line, an image corresponding to the symbols is displayed in the liquid-crystal panel 26. Further, the image converges toward LEDs assigned to the corresponding symbol, thereby incrementing the number of LEDs assigned to the symbols by one, Thus, the player can ascertain the number of times winning combinations of symbols have appeared, by the number of illuminating LEDs.

When the number of illuminating LEDs for a specific symbol has reached a specified number of times; for example, seven, the color of all the LEDs changes, or the LEDs blink, thereby informing the player that a reward (including the state of a specific game) corresponding to the symbol is provided to the player.

The nature of a reward is set beforehand according to the specific symbol. For example, in the case of symbols "CHERRY," "ORANGE," and "BELL," a period of free spin is commenced. For example, in relation to symbol "CHERRY," a period of free spin is one game. In relation to symbol "ORANGE," a period of free spin is two games. In relation to symbol "BELL," a period of free spin is three games. Thus, the period of free spin may be weighted according to the specific symbol. In the case of symbols "WATERMELON," "BAR," and "7" internal flags assigned to the respective symbols are set in the next game, thereby increasing the probability of the symbols being aligned or bringing the games into a period during which the leading control operation is not performed.

As a reward for having reached a specified number of times, the player is given a gaming value (e.g., gaming tokens), or the lottery processor entitles the player to attain a win by a winning combination in the next game. In the case of a gaming machine which determines a winning symbol beforehand through internal lottery operation, the result of internal lottery operation may be afforded to the player in the next game (e.g., reporting, to the player, guidance for aligning specific symbols through use of lamp indications or the like).

Further, the game condition controller 41 is equipped with a counter for counting the number of games. A predetermined number of games is compared with the number of games counted by the counter. If the counted number of games is greater, the previously-described reward is not necessarily given to the player. For example, the game condition controller 41 may perform a control operation such that no reward is afforded to the player unless a winning combination of symbols appears five times during the course of 30 games.

A specific combination of symbols which are objects of counting may be a winning combination symbols or a combination of symbols other than the winning combination of symbols. Alternatively, the specific combination of symbols may be constituted of symbols, only one of which differs from a combination of symbols constituting a winning combination.

By such a control operation, the player can readily ascertain the extent to which the number of times a winning combination of symbols has appeared has increased since the game was started, the extent to which the predetermined combination of symbols has been stored since the game was started, or the number of times which remain before seven (i.e., a specified number) is achieved to attain a specific game status or acquire a reward. Thus, the amusement of continuing games can be enhanced.

The number of previously-described LEDs, examples of corresponding symbols, and the kinds of specific games corresponding to symbols are not limited to those mentioned above. Further, the number-of-times display sections 24*g* have been used as an indicator for the number of times a winning combination has appeared. However, the number of times may be graphically displayed on the liquid-crystal panel 26.

The embodiment has described that, when symbols corresponding to a predetermined winning combination are aligned with a winning line, the number of times the symbols have been aligned; that is, the number of times a predetermined winning combination has appeared, is displayed by the number-of-times display. However, the present invention is not limited to such an embodiment. In other words, the present invention may be applied to a case where a winning combination has not appeared despite symbols corresponding to a predetermined winning combination having been aligned with a winning line (e.g., a case where two identical specific symbols or three different specific symbols have been aligned).

Next, there will be described a case where the present invention is applied to a poker gaming machine, as a second embodiment of the invention. The poker gaming machine according to the embodiment is a gaming machine which displays a plurality of cards on a display screen, exchanges cards other than those determined as necessary by the player with new cards, and provides a predetermined payout when a combination of cards corresponds to a winning combination.

Figure 10:
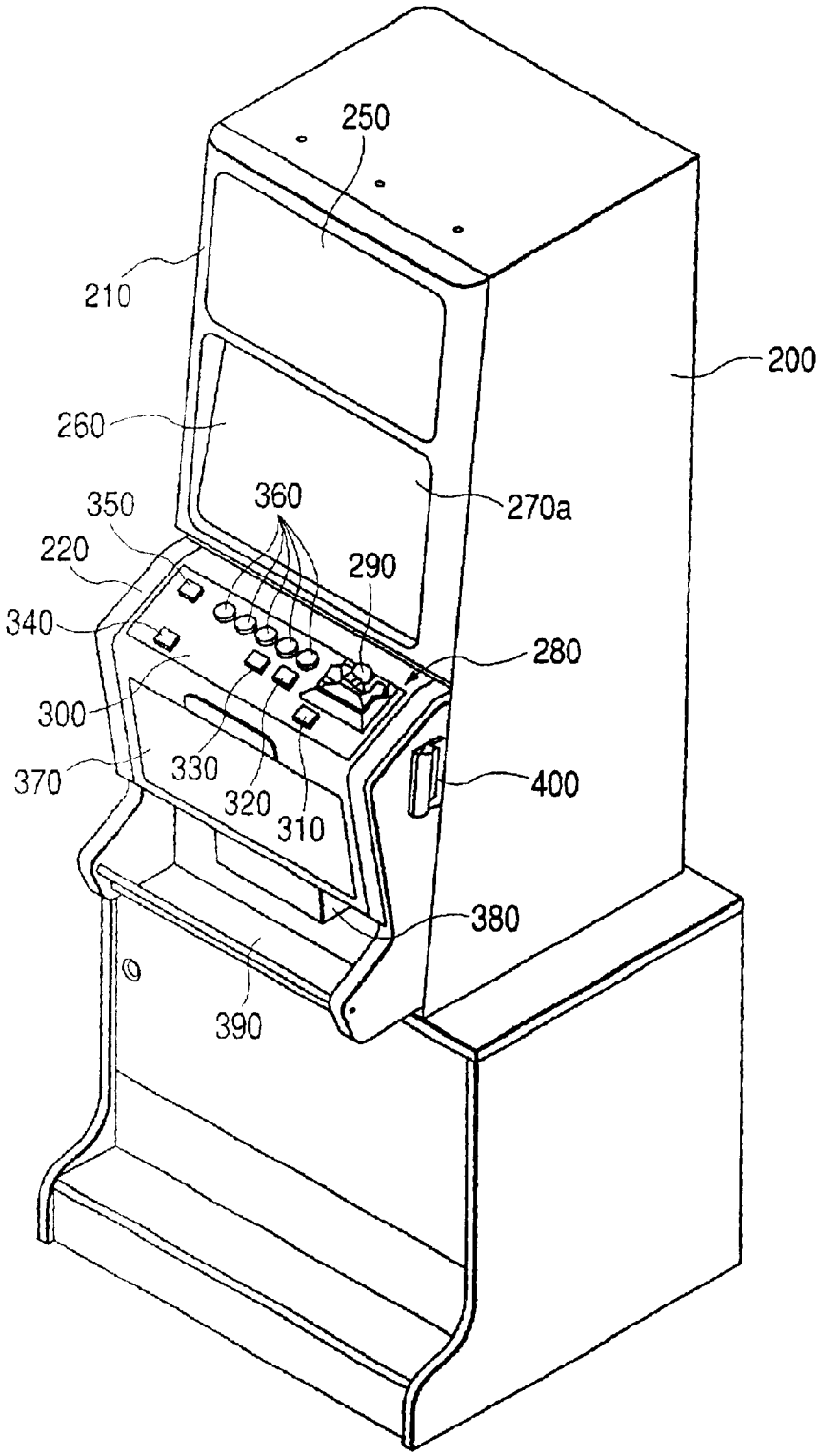
FIG. 10 is a perspective view showing a poker gaming machine according to a second embodiment of the invention.
Figure 11:
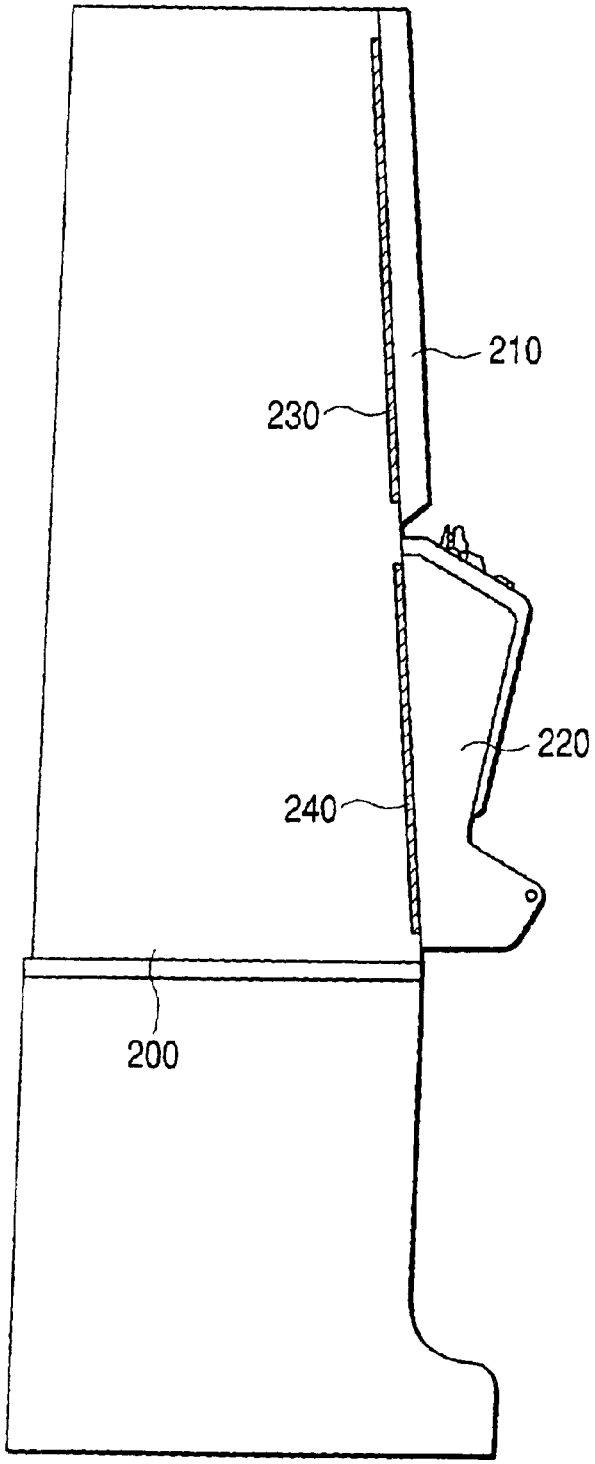
FIG. 11 is a side view showing the poker gaming machine.
Figure 12:
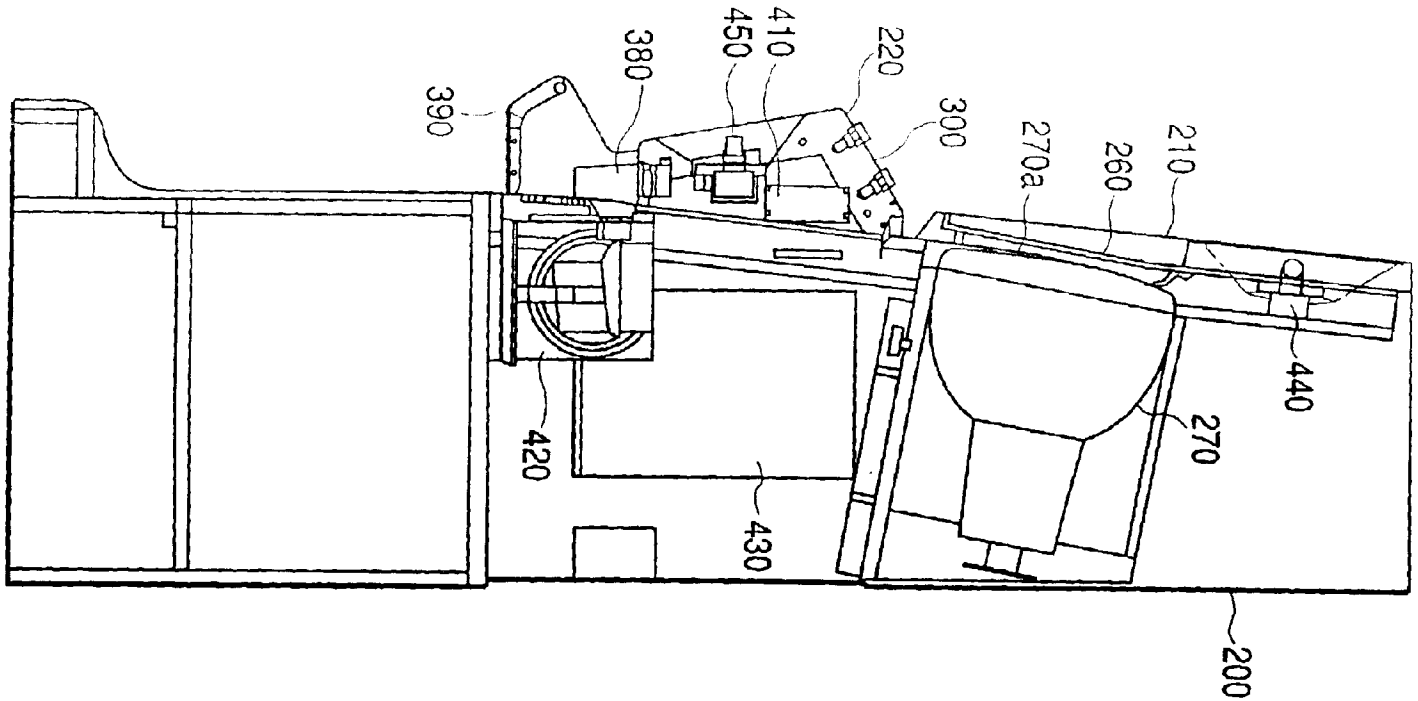
FIG. 12 is a cross-sectional view showing the poker gaming machine.

As shown in FIGS. 10 through 12, a box-shaped main body 200 which houses various types of devices to be described later. A first door member 210 and a second door member 220, which are formed separately from each other, are provided on the front face of the main body 200. The first door member 210 is independently supported by a hinge member 230 (shown in only FIG. 11) so as to be horizontally reclosable. Similarly, the second door member 220 is independently supported by a hinge member 240 (shown in only FIG. 11) so as to be horizontally reclosable. Opening and closing actions of the respective first and second door members 210, 220 are usually restricted by unillustrated lock mechanisms. When the locks are released by keys, opening and closing actions of the respective first and second door members 210, 220 become feasible.

The first door member 210 is provided in an upper part of the front face of the main body 200. A title panel 250 having the title of the poker gaming machine according to the embodiment described thereon is placed on the first door member 210. A display window section 260 is provided below the first door member 210. A player can observe a display screen 270*a* of a CRT 270 via the display window section 260. By an unillustrated display controller, five cards are displayed so as to be arranged in a horizontal row, faceup or facedown. Further, odds for each winning combination, the number of inserted gaming tokens, and the number of wagered gaming tokens are displayed.

The second door member 220 is provided in a lower part of the front face of the main body 200. The upper part of the second door member 220 bulges toward the front (i.e., the right-side direction in FIG. 11), whereby an upper face of the thus-bulging portion acts as a console section 280. A token insertion slot 290 is formed in the right-end portion of the console section 280, and a control panel 300 is also provided, in the center. The token insertion slot 290 is for enabling insertion of gaming tokens into the main body 200 on a one-by-one basis. The construction of the token insertion slot 290 is known, and hence a detailed explanation thereof is omitted.

Figure 13:
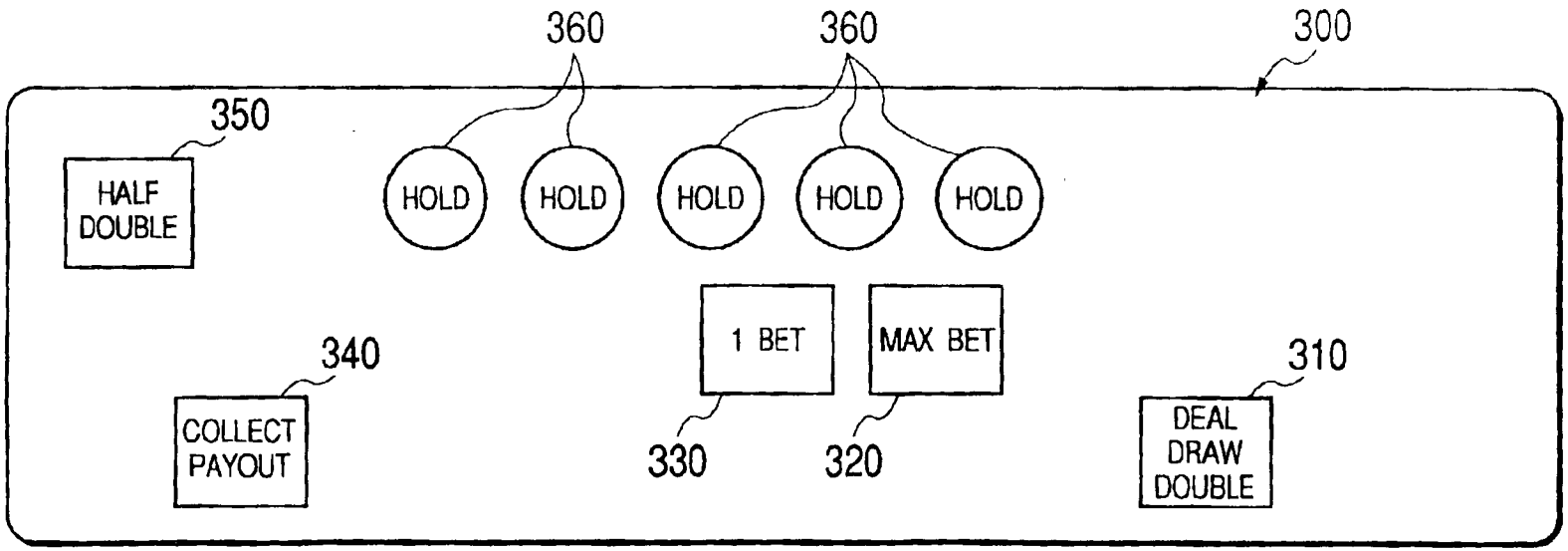
FIG. 13 is an enlarged front view showing a control panel of the poker gaming machine.

FIG. 13 is a plan view showing the control panel 300 in an enlarged manner. Ten push buttons are provided on the control panel 300. Namely, there are provided, in order from the right when viewed from the player's position, a deal/draw (DEAL/DRAW) button 310, a max-bet (MAX BET) button 320, a one-bet (1 BET) button 330, a collection/payout (COLLECT/PAYOUT) button 340, and a half/double (HALF/DOUBLE) button 360. Further, five hold (HOLD) buttons 360 are disposed at a position away from the player (i.e., an upper position in FIG. 13). The hold buttons 360 are set so as to be situated at a position below and close to the five cards appearing on a display screen 270*a*. Lamps (designated by reference numeral 550 shown in FIG. 14) which illuminate when the player presses the corresponding push buttons 310 through 360 are provided in the respective push buttons 310 through 360.

Turning back to FIGS. 10 through 12, a title panel 370 having printed thereon the title of the poker gaming machine according to the embodiment. The title panel 370 is provided in the center of the second door member 220. A token payout port 380 is disposed at the lower part of the second door member 220. Gaming tokens are paid, byway of the token payout port 380, from a hopper 420 to be described later. The gaming tokens paid by way of the token payout port 380 are reserved in a token receiver 390 provided at the lower end of the second door member 220 Here, a knob 400 is provided on a right-side section of the second door member 220.

As shown in FIG. 12 in detail, disposed on the back of the second door member 220 is a token identifier 410 which detects insertion of a gaming token by way of the token insertion slot 290 and identifies the kind of the inserted gaming token and whether the inserted gaming token is genuine or counterfeit. The hopper 420 temporarily stores the gaming tokens detected and identified by the token identifier 410. Upon receipt of an instruction from a controller to be described later, the hopper 420 counts a predetermined number of gaming tokens and pays out the gaming tokens by way of the token payout port 380. A controller 430 controls the entire poker gaming machine according to the embodiment. A lighting fixture 440 is attached to the back of the first door member 210 and backlights the title panel 250, A lighting fixture 450 is attached to the back of the second door member 220 and backlights the title panel 370.

Figure 14:
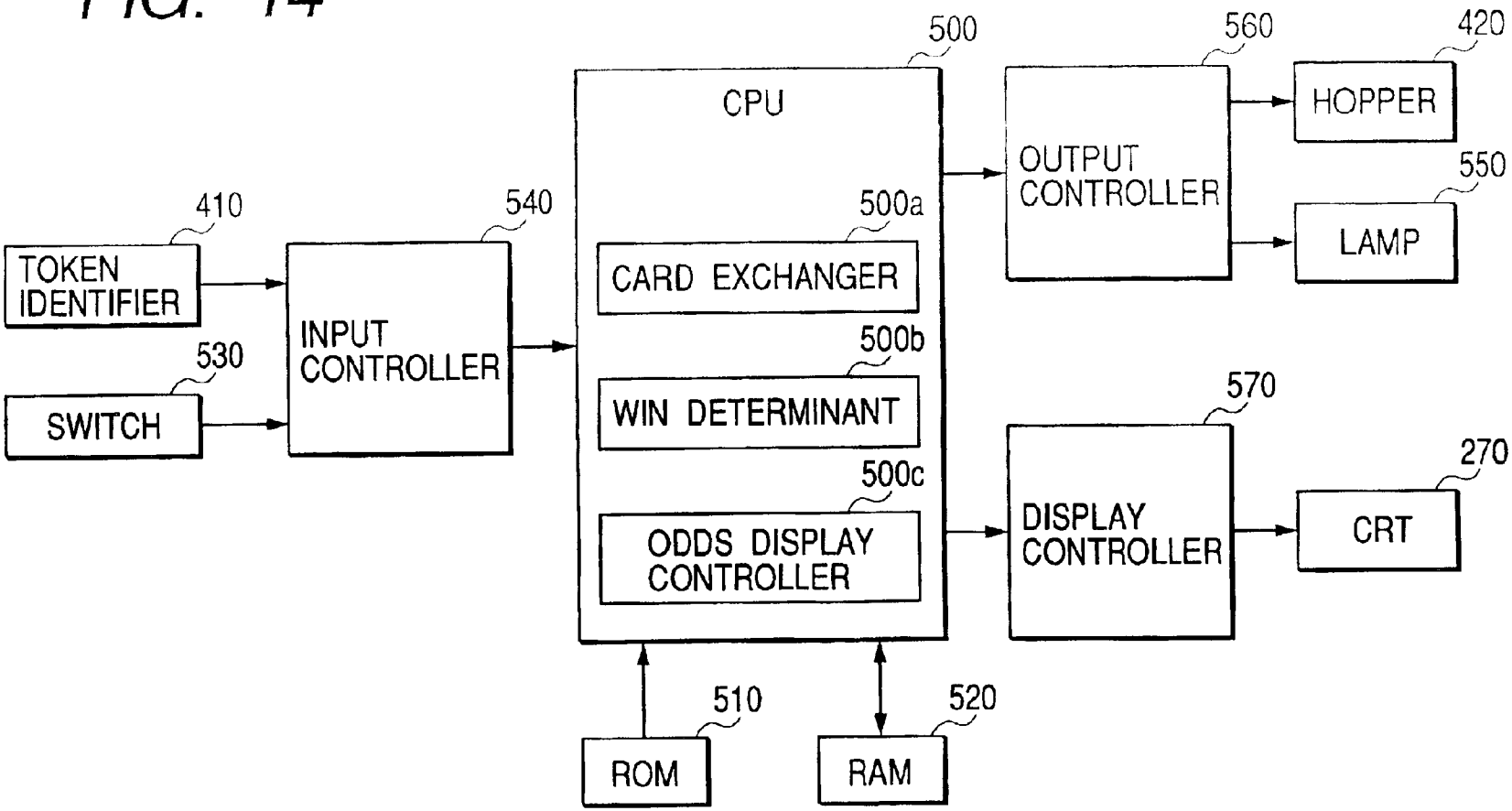
FIG. 14 is a block diagram showing the system configuration of the poker gaming machine.

FIG. 14 is a block diagram showing the configuration of a poker gaming machine according to the embodiment. A CPU 500 controls various operations in accordance with a program stored in ROM 510, thus governing progress in the overall game.

Disposed in the CPU 500 are a card exchanger 500*a*, a win determinant 500*b*, and an odds display controller 500*c*. The card exchanger 500*a* displays and exchanges a card (designated by 630 in FIG. 15) for which a corresponding hold button 360 has not been pressed, in response to the player pressing the deal/draw button 310, The win determinant 500*b* determines whether or not a combination of cards defined by exchanging some (or all) of the cards through depression of the deal/draw button 310 corresponds to a predetermined winning combination. The odds display controller 500*c* sends, to a display controller 570 to be described later, a control signal for displaying on the display screen 270*a* of the CRT 270 the odds of a winning combination arising. The odds display controller 500*c* performs a display control operation so that the player can visually distinguish odds of a winning combination which is currently available by a card exchange instruction or odds of a winning combination which may arise as a result of exchange of cards from odds of the other winning combinations.

Stored in the ROM 510 are cards, character data for preparing characters, and a program for controlling an image, as well as the program for controlling the entire gaming machine. RAM 520 temporarily stores various data output from the CPU 500 or the like.

Switches 530 are assigned to the respective push buttons 310 through 360 and send a signal upon detection the corresponding push button 310 through 360 being depressed. A depression detection signal output from the switch 530 and a token insertion detection signal output from the token identifier 410 are input to the CPU 500 by way of an input controller 540. The CPU 500 outputs a signal for controlling lamps 550 assigned to the respective push buttons 310 through 360 and a signal for controlling the hopper 420. These control signals are delivered to the lamps 550 and the hopper 420 by way of an output controller 560, Similarly, the CPU 500 sends, to a display controller 570, a display control signal required for causing a game to proceed. In accordance with the control signal, the display controller 570 sends, to the CRT 270, an image signal required for displaying a required image on the display screen 270*a* of the CRT 270.

Here, the controller according to the invention corresponds to the CPU 500, and the storage according to the invention corresponds to the RAM 520. The determinant and the signal generator according to the invention correspond to program processing to be performed by the CPU 500.

Figure 15:
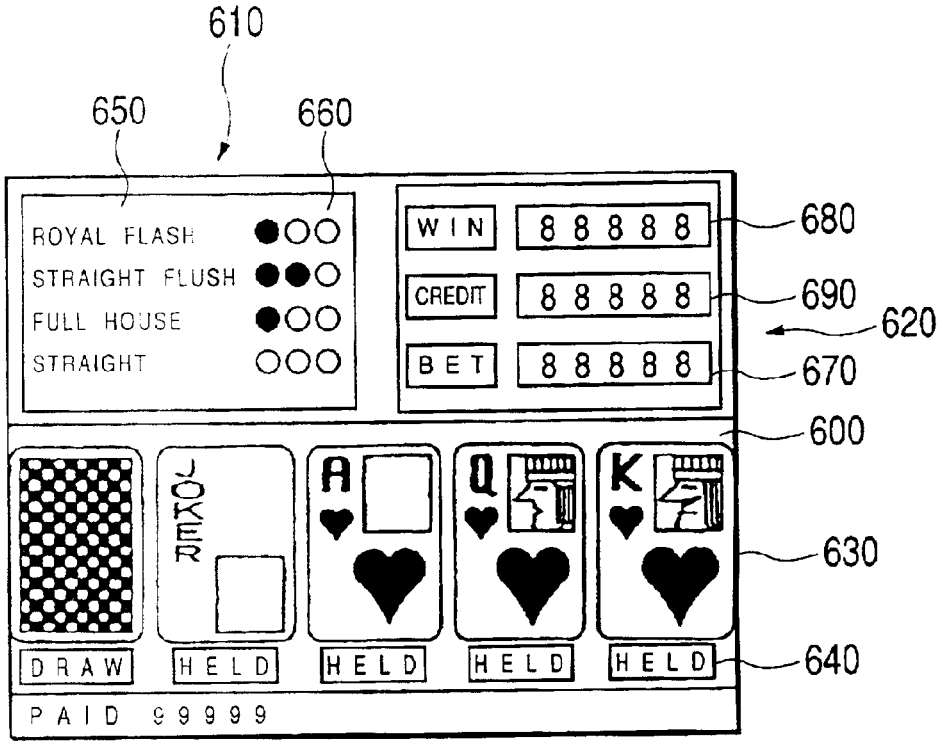
FIG. 15 is a schematic diagram showing an example display screen.

FIG. 15 shows an example of an image to be displayed on the display screen 270*a* of the poker gaming machine according to the invention. Provided on the display screen 270*a* are a card display section 600, an odds table display section 610, and a wagered token display section 620.

Five cards 630 are displayed in the form of a horizontal row in the card display section 600. Hold display sections 640 for displaying selection of a player as to whether or not some (or all) of the cards 630 are to be exchanged are displayed in a position beneath the respective cards 630. When the player has instructed that cards do not require exchange (i.e., when the player has pressed some (or all) of the hold buttons 360), signs "HOLD" are displayed in the corresponding hold display sections 640. In contrast, when the player has not yet selected whether to exchange cards or to hold cards, signs "HOLD" are displayed. When the player has instructed exchange of cards by depressing the deal/draw button 310, the thus-exchanged and selected card 630 is temporarily turned facedown (i.e., the card 630 placed at the left end in FIG. 15). Further, sign "DRAW" is displayed in the hold display section 640 corresponding to the card 630. Subsequently, a new card 630 is displayed.

The odds table display section 610 is provided with winning combination display sections 650 for displaying predetermined winning combinations.

The wagered token display section 620 has a bet display section 670 for displaying the number of gaming tokens wagered (or bet) by the player, an acquired token display section 680 for displaying the number of gaming tokens determined by multiplying the number of wagered gaming tokens with an odds when a winning combination is constituted by the cards 630 currently appearing in the card display section 600; that is, the number of gaming tokens acquired by the player for acquiring a winning combination; and a held token display section 690 for displaying a total number of gaming tokens currently inserted and acquired by the player; that is, the number of gaming tokens held by the player.

Next, the operation of the poker gaming machine according to the embodiment will be described. When the player inserts a gaming token by way of the token insertion slot 290, a game is started. First, the player designates how many of the inserted gaming tokens are to be wagered (bet) on a game, by the one-bet button 330 or the max-bet button 320. The CPU 500 detects depression of either the one-bet button 330 or the max-bet button 320 and performs a control operation for changing a display on the bet display section 670.

Next, the CPU 500 waits for the player to press the deal/draw button 310. Upon detection of depression of the deal/draw button 310 the CPU 500 displays five cards 630 faceup on the display screen 270*a* of the CRT 270 by way of the display controller 570.

The player selects any cards 630 that require exchange for constituting a winning combination and/or any cards 630 which do not need to be exchanged. The player presses the hold buttons 360 corresponding to the cards 630 not requiring exchange, thereby instructing obviation of a necessity for exchange. The odds display controller 500*c* determines a winning combination which is constituted by the cards 630 that do not require exchange; namely, the cards 630 for which the hold buttons 360 are not pressed, and a winning combination which may be constituted by exchange of the cards instructed by the player.

The odds display controller 500*c* determines whether or not a winning combination has already been formed. If a winning combination has been formed, the odds display controller 500*c* performs a display control operation so as to highlight the winning combination display section 650 and the number-of times display section 660 (described later), which correspond to the winning combination. Under normal circumstances, the odds display controller 500*c* performs a display control operation for displaying a winning combination display section 650 and an number-of times display section 660, which correspond to the winning combination that has been determined by the odds display controller 500*c* as having a chance of occurrence. The odds display controller 500*c* performs a display control operation for displaying dimly a winning combination display section 650 and an number-of times display section 660, which correspond to the winning combination that has been determined by the odds display controller 500*c* as having no chance of occurrence.

Next will be described display of the number of specific combinations of symbols in the poker gaming machine according to the embodiment. As shown in FIG. 15, the number-of times display section 660 show the number of times predetermined combinations of the cards 630 have been obtained in the poker gaming machine. For instance, the number of times the cards 630 having been aligned into a specific combination, such as "ROYAL FLUSH" or "STRAIGHT FLUSH," is displayed on the display screen for each corresponding combination. When the cards 630 have been aligned into a specific combination, the number of times a corresponding winning combination has been constituted is displayed after having been incremented.

The number of times displayed shows a total number of times counted since the display was last reset. When a predetermined number of times is achieved, a predetermined reward is afforded to the player, and all or some of the number of times are deleted Here, a reward to be afforded is determined in accordance with, e.g., a combination of cards 630. For instance, the player is allowed to start a specific game, to start the next game without wagering a gaming token, to receive a predetermined amount of gaming tokens, or is entitled the right to win a specific combination of cards 630 in the next game.

Even when the player is playing a game continuously over a long time period, the number of times a specific combination of cards 630 has appeared or the enjoyment of acquiring a reward in return for having achieved a predetermined number of times is increased or enhanced by such a display of the number of times and affording of a reward. Hence, the player is given incentive to play a game continuously.

The invention has been described by taking, as examples, a skill-stop type slot machine and a poker gaming machine. However, the present invention may be applied to amusement equipment, including, e.g., a lever-type slot machine. Consequently, variable display according to the invention are not limited to the barrel type such as the three reels 31*a* through 31*c* described in connection with the embodiments. For instance, the variable display may be a video display type constituted of, e.g., a CRT (cathode-ray tube). Variable display of video display type are applicable to gaming machines; e.g., a video slot machine, a blackjack gaming machine, or a hanahuda (Japanese playing cards) gaming machine. Reels or rotary display sections are not limited to three in number; they may assume another number, such as one or two.

What is claimed is:

1. A gaming machine, comprising:

a first display, which displays a predetermined number of symbols among a plurality of symbols including at least one special symbol; and a controller, which includes:

a storage, which stores a first number of times that a special symbol combination has appeared on the first display, the special symbol combination includes a first symbol combination in which at least one special symbol is included and a second symbol combination which is a predetermined combination of the symbols;

a determinant, which determines whether the first number of times stored in the storage is not less than a second, predetermined number of times; and a signal generator, which generates an award signal for causing the gaming machine to provide an award to a player in accordance with the special symbol combination displayed on the first display, when the determinant determines the first number of times is not less than the second number of times.

2. The gaming machine as set forth in claim 1, wherein the controller includes a lottery processor, which determines the second number of times.

3. The gaming machine as set forth in claim 1, wherein the controller determines the symbol combination displayed on the first display.

4. The gaming machine as set forth in claim 1, wherein:

the controller includes a counter, which counts a third number of times that a basic game is played, and compares with a fourth number of times; and the signal generator is prohibited to generate the award signal when the third number of times is not less than the fourth number of times.

5. The gaming machine as set forth in claim 1, wherein the second symbol combination is a special hand defined in a game.

6. The gaming machine as set forth in claim 1, wherein the second symbol combination is a symbol combination other than a special hand defined in a game.

7. The gaming machine as set forth in claim 6, wherein the second symbol combination is a symbol combination in which only one symbol is different from the special hand.

8. The gaming machine as set forth in claim 1, wherein the second symbol combination is a specific symbol combination that appears at a location specified by the player.

9. The gaming machine as set forth in claim 1, wherein the second symbol combination is a symbol combination different from a specific symbol combination that appears at a location specified by the player.

10. The gaming machine as set forth in claim 9, wherein the symbol combination is a symbol combination in which only one symbol is different from the specific symbol combination.

11. The gaming machine as set forth in claim 1, wherein the award is a specific game which is different from a basic game.

12. The gaming machine as set forth in claim 1, wherein the award is at least one basic game which requires no gaming value wagered.

13. The gaming machine as set forth in claim 1, wherein the award is gaming values.

14. The gaming machine as set forth in claim 1, wherein the award is a higher probability that the special symbol combination appears in a next game.

15. The gaming machine as set forth in claim 1, wherein the award is a promise that the special symbol combination appears in a next game.

16. The gaming machine as set forth in claim 1, further comprising a second display, wherein the first number of times is displayed on either one of the first display or the second display.

17. The gaming machine as set forth in claim 1, wherein the special game is at least one additional play of the basic game.

18. The gaming machine as set forth in claim 1, wherein the controller determines a time period in which the additional play is effected, in accordance with the special combination appeared on the winning line.

* * * * *